US006518569B1

(12) United States Patent
Zhang et al.

(10) Patent No.: US 6,518,569 B1
(45) Date of Patent: Feb. 11, 2003

(54) ION MIRROR

(75) Inventors: Jun Zhang, Albuquerque, NM (US); Benjamin D. Gardner, Albuquerque, NM (US); Christie G. Enke, Albuquerque, NM (US)

(73) Assignee: Science & Technology Corporation @ UNM, Albuquerque, NM (US)

( * ) Notice: Subject to any disclaimer, the term of this patent is extended or adjusted under 35 U.S.C. 154(b) by 328 days.

(21) Appl. No.: 09/591,536

(22) Filed: Jun. 9, 2000

Related U.S. Application Data

(60) Provisional application No. 60/138,903, filed on Jun. 11, 1999.

(51) Int. Cl.[7] ..... H01J 49/00

(52) U.S. Cl. ..... 250/287; 250/396 R

(58) Field of Search ..... 250/287, 396 R

(56) References Cited

U.S. PATENT DOCUMENTS

| | | | | |
|---|---|---|---|---|
| 4,625,112 | A | 11/1986 | Yoshida | |
| 4,731,532 | A | 3/1988 | Frey et al. | |
| 5,017,780 | A | 5/1991 | Kutscher et al. | |
| 5,077,472 | A | 12/1991 | Davis | |
| 5,117,107 | A | 5/1992 | Guilhaus et al. | |
| 5,202,563 | A | 4/1993 | Cotter | |
| 5,464,985 | A | 11/1995 | Cornish | |
| 5,641,959 | A | 6/1997 | Holle et al. | |
| 5,654,545 | A | 8/1997 | Holle et al. | |
| 5,734,161 | A | 3/1998 | Koster | |
| 5,742,049 | A | 4/1998 | Holle et al. | |
| 5,753,909 | A | 5/1998 | Park et al. | |
| 5,814,813 | A | 9/1998 | Cotter et al. | |
| 5,847,385 | A | * 12/1998 | Dresch | 250/287 |
| 5,955,730 | A | 9/1999 | Kerley et al. | |

OTHER PUBLICATIONS

Yefchak, G.E., et al., "Improved Method for Designing a Cylindrical Zhang–Enke Ion Mirror," *Intl J of Mass Spec*, vol. 214, pp 89–94 (2002).

Cornish, T.J., et al., "A Curved Field Reflectron Time–of–Flight Mass Spectrometer for the Simultaneous Focusing of Metastable Product Ions," *Rapid Comm. in Mass Spectrom.*, vol. 8, pp 781–785 (1994).

Cornish, T.J., et al., "High–Order Kinetic Energy Focusing in an End Cap Reflectron Time–of–Flight Mass Spectrometer," *Anal. Chem.*, vol. 69, pp 4615–4618 (1997).

Dawson, J.H.J., et al., "Orthogonal–Acceleration Time–of–Flight Mass Spectrometer," *Rapid Comm. in Mass Spectrom.*, vol. 3, No. 5, pp 155–159 (1989).

Dodonov, A.F., et al., "Electrospray Ionization on a Reflecting Time–of–Flight Mass Spectrometer," *Electrospray Ionization*, ACS Symposium Series 549, Chapter 7, American Chemical Society, Washington, DC pp 108–123 (1994).

JI, Q., et al., "A Segmented Ring, Cylindrical Ion Trap Source for Time–of–Flight Mass Spectrometry," *J. Am. Soc. Mass Spectrom.*, vol. 7, pp 1009–1017 (1996).

(List continued on next page.)

*Primary Examiner*—Kiet T. Nguyen
(74) *Attorney, Agent, or Firm*—Jeffrey D. Myers; Brian J. Pangrle

(57) ABSTRACT

Novel ion mirrors comprising, in a preferred embodiment, three cylinders, rectangles or truncated cones to improve the resolving power in the time-of-flight mass spectrometers over broad ion kinetic energy ranges. The achieved electric field is non-linear along the mirror axis and relatively homogeneous in the mirror off-axis directions. Combined with dimension optimization, in a preferred embodiment, the adjustment of only two parameters of element voltages can yield preferred electric field distribution to fit different ion optical systems.

23 Claims, 29 Drawing Sheets

OTHER PUBLICATIONS

Karataev, V.I., et al., "New Method for Focusing Ion Bunches in Time–of–Flight Mass Spectrometers," *Sov. Phys. Tech. Phys.*, vol. 16, No. 7, pp 1177–1179 (Jan. 1973).
Krutchinsky, A.N., et al., "Collisional Damping Interface for an Electrospray Ionization Time–of–Flight Mass Spectrometer," *J. Am. Soc. Mass Spectrom.*, vol. 9, pp 569–579 (1998).
Krutscher, R., et al., "A Transversally and Longitudinally Focusing Time–of–Flight Mass Spectrometer," *Int. Mass Spectrom. Ion Processes*, vol. 103, pp 117–129 (1991).
Rockwood, A.L., *Proceedings of the 34th ASMS Conf. on Mass Spectrom. and Allied Topics*, Cincinnati OH pp173–174 (Jun. 8–13, 1985).
Scherer, S., et al., "Prototype of a Reflection Time–of–Flight Mass Spectrometer for the Rosetta Comet Rendezvous Mission," *Proc of the 46th ASMS Conf. on Mass Spectrom. and Allied Topics*, p 1238 (May 31–Jun. 4, 1998).
Verentchikov, A.N., et al., "Reflecting Time–of–Flight Mass Spectrometer with an Electrospray Ion Source and Orthogonal Extraction," *Anal. Chem.*, vol. 66, No. 1, pp 126–133 (Jan. 1, 1994).
Wiley, W.C., "Bendix Time–of–Flight Mass Spectrometer," *Science*, vol. 124, pp 817–820 (1956).
Wiley, W.C., et al., "Time–of–Flight Mass Spectrometer with Improved Resolution," *Rev. Sci. Instru.*, vol. 26, No. 2, pp 1150–1157 (Dec. 1955).
Zhang, J., et al., "Simple Cylindrical Ion Mirror with Three Elements," *J. Am. Soc. Mass Spectrom.* vol. 11, pp 759–764 (2000).
Zhang, J., et al., "Simple Geometry Gridless Ion Mirror," *J. Am. Soc. Mass Spectrom.* vol. 11, pp 765–769 (2000).
Zhang, J., et al, "A Three–Element, High Resolution Ion Mirror for Orthogonal Acceleration TOP Mass Spectrometry," *J. Amer. Soc. Mass Spectrom.* (2000) (in press).

* cited by examiner

ION MIRROR

CROSS-REFERENCE TO RELATED APPLICATIONS

This application claims the benefit of the filing of U.S. Provisional Patent Application Ser. No. 60/138,903, entitled "Simple geometry ion mirrors for improved energy-focusing in time-of-flight mass spectrometer," filed on Jun. 11, 1999, and the specification thereof is incorporated herein by reference.

GOVERNMENT RIGHTS

The U.S. Government has a paid-up license in this invention and the right in limited circumstances to require the patent owner to license others on reasonable terms as provided for by the terms of Contract No.2 RO1 GM44077 awarded by the U.S. National Institutes of Health.

BACKGROUND OF THE INVENTION

1. Field of the Invention (Technical Field)

The present invention relates to ion mirrors for mass spectrometry.

2. Background Art

In the earliest time-of-flight (TOF) mass spectrometers, ions were extracted from a source by a single linear extraction field to a field-free region. The arrival times of ions that traversed this region varied as a function of their m/z (mass/charge) ratios.

Two articles by Wiley and McLaren (Wiley, W. C.; McLaren, I. H. *Rev. Sci. Instrum.*, 26, 1150 (1955) and Wiley, W. C. *Science*, 124, 817 (1956)) disclose that the space focus plane could be moved to the detector plane with a two-field extraction. Wiley and McLaren also combined this with time-lag extraction. Time-lag extraction transformed the ion thermal energy distribution into a spatial distribution that was subsequently corrected by space focusing at the detector. The disadvantage of the time-lag extraction is its mass dependence, which prevents simultaneous focusing over the whole m/z range.

An ion mirror introduced by Karataev et al. (Karaev, V. I; Mamyrin, B. A.; Shmikk, D. V.; A. *Sov. Phys. Tech. Phys.*, 16, 1173 (1972)) solved the focusing problem reported by Wiley and McLaren. To solve the problem, a potential hill in the ion mirror was introduced, which produced a longer flight path for more energetic ions. Thus, due to the potential hill, two ions with the same m/z value but different kinetic energies spend different amount of time in the ion mirror. For example, an ion with higher kinetic energy spends less time in the field free region but penetrates deeper into the ion mirror, while an ion with lower kinetic energies spends more time in the field free region but penetrates the ion mirror less deeply. Thus, the ion mirror compensates for much of the difference in ion kinetic energies.

However, the ion mirror of Karaev et al. could not correct for initial kinetic energy distribution and/or spatial distribution of ions in the ion source at the same time. Essentially, the turn-around time of ions with random thermal motion in the source cannot be eliminated at the time of extraction; therefore, the turnaround time eventually limits the achievable resolving power unless random ion motion is avoided.

To effectively minimize the initial kinetic energy distribution along the time-of-flight (TOF) axis of an ion, orthogonal acceleration was introduced, referred to herein as "TOF-oa." Theoretically, when TOF-oa is combined with a mirror that has an optimum field shape, a high-resolution mass spectrometer should be achieved.

In 1989, Dawson and Guilhaus built the first TOF-oa instrument for improving resolving power and duty cycle with an electron impact (El) ion source (Dawson, J. H. J.; Guilhaus, M., *Rapid Commun. Mass Spectrom.*, 3, 155 (1989) and Dawson, J. H. J.; Guihaus, M. Australian Provisional Patent P16079, 1987; Int. Patent Appl. PCT/AU88/00498, 1988) and U.S. Pat. No. 5,117,107. According to the Dawson and Guilhaus instrument, ions are collimated by an electrostatic lens system and injected into an orthogonal extraction region. As a result, in a linear TOF instrument, the ion extraction and acceleration fields provide space focusing at the detector. The Dawson and Guilhaus instrumented reportedly achieved a resolution of 2000 at full width at half maximum (FWHM) of a spectral peak.

Dodonov et al. (Dodonov, A. F.; Chernushevich, I. V.; Laiko, V. V., International Mass Spectrometry Conference, Amsterdam, August 1991; Extended Abstracts, p153 and Dodonov, A. F.; Chernushevich, I. V.; Laiko, V. V. in Time-of-Flight Mass Spectrometry; Cotter, R. J. Ed.; ACS Symposium Series 549; American Chemical Society, Washington, DC, 1994. pp108–23) developed an orthogonal acceleration instrument that coupled electrospray ionization (ESI) and a dual-stage ion mirror mass analyzer with a resolution of about 1000 (FWHM).

Verentchikov et al. (Verentchikov, A. N.; Ens, W.; Standing, K. G., *Anal. Chem.*, 66, 126 (1994)). reported an orthogonal acceleration instrument with a resolution of about 5000 (FWHM) by using a single-stage ion mirror. An improvement of this instrument reportedly achieved a resolution between 7000 and 10000 (FWHM) (Krutchinsky, A. N.; Chernushevich, I. V; Spicer, V. L.; Ens W.; Standing, K. G., *J. Amer. Soc. Mass Spectrom.*, 9, 569 (1998)).

To date, ion mirrors have been a key element in providing improved resolution over the entire m/z range. In general, ion mirrors can be divided into two groups, linear and non-linear, according to the distribution of the electric field within the mirror. Linear ion mirrors are referred to as staged ion mirrors. Staged ion mirrors may have one or more stages, each stage having a linear electric field. In contrast, a non-linear ion mirror has an electric field contour that is curved along the mirror axis, particularly, in an ion turn-around region. Researchers have demonstrated that non-linear ion mirrors can achieve higher resolution than can linear ion mirrors (Cornish, T. J. and Cotter, R. J., *J. Rapid Commun. Mass Spectrom.*, 8, 781–785 (1994)). Depending on the system, an "ideal" non-linear ion mirror should exist. An ideal non-linear ion mirror preferably has an electric field with the theoretically optimum contour along the mirror axis and an absolutely homogeneous field in the off-axis directions. Inhomogeneity in the off-axis, or radial, directions results in ion dispersion away from the beam center and inequity in ion flight time across the useful beam diameter. Therefore, an ion mirror with a large off-axis homogeneous region near the beam center is desirable, in turn, an enlarged, useable beam center region results.

An "ideal" ion mirror should achieve infinite order focusing of kinetic energy as reported by Rockwood, A L., Proceedings of the $34^{th}$ ASMS Conference on Mass Spectrometry and Allied Topics; Cincinnati, Ohio, June 8–13, P173 (1986). The voltage in the electric field of an "ideal" ion mirror follows the parabolic equation $U=ax^2$ where a is a constant and x is the depth in the ion mirror along the axial direction. Unfortunately, such a parabolic field ion mirror is difficult to implement and has the disadvantage of having no field-free flight path.

To date, ion mirrors have primarily used two different configurations to create a non-linear electric field. One reported configuration uses stacks of many ring-like diaphragm elements (U.S. Pat. No. 4,625,112, entitled "Time of flight mass spectrometer," to Yoshida, issued Nov. 25, 1986; U.S. Pat. No. 5,464,985, entitled "Non-linear field reflection," to Cornish and Cotter, issued Nov. 7, 1995; U.S. Pat. No. 5,017,780, entitled "Ion reflector," to Kutscher et al., issued May 21, 1991) while the other configuration uses simple geometric shapes (Cornish, T. J; Cotter. R. J., *J. Anal. Chem.*, 69, 4615 (1997); U.S. Pat. No. 5,814,813 entitled "End cap reflection for a time-of-flight mass spectrometer and method of using the same," to Cotter et al, issued Sep. 29, 1998; U.S. Pat. No. 5,077,472, entitled "Ion mirror for a time-of-flight mass spectrometer," to Davis, issued Dec. 31, 1991).

Disadvantages of the stacks of ring-like diaphragm configuration are the non-homogeneity of the electric field in the off-axis directions and the number of conductive elements required. Each additional element adds critical spatial and voltage control requirements. Although the reported configurations that use simple geometric shapes are easier to implement for non-linear electric fields, off-axis homogeneity has, to date, limited the achievable resolution. Therefore, a need exists for an ion mirror that is not as limited by off-axis inhomogeneity or the requirements inherent in the use of a large number of elements.

U.S. Pat. No. 5,017,780, entitled "Ion reflector," to Kutscher et al., issued May 21, 1991, discloses an ion mirror with at least one special element of conical construction and many ring-like diaphragms. The implementation is difficult, in part, because all the conductive elements require distinct voltages and tight focusing of the ion beam close to the mirror axis, since their equipotential lines are not parallel and result in divergence of the ion trajectories for off-axis ions.

Note that the following discussion refers to a number of publications by author(s) and year of publication, and that due to recent publication dates certain publications are not to be considered as prior art vis-a-vis the present invention. Discussion of such publications herein is given for more complete background and is not to be construed as an admission that such publications are prior art for patentability determination purposes.

SUMMARY OF THE INVENTION (DISCLOSURE OF THE INVENTION)

In a preferred embodiment, the present invention comprises an apparatus for affecting charged particles comprising at least two tube-shaped, electrically conductive elements arranged along a common axis wherein each of the at least two elements comprises a finite length; and at least one voltage source for providing a voltage to at each of the at least two elements wherein the provided voltage produces an electrical field comprising field lines perpendicular to the common axis for affecting charged particles travelling substantially parallel to the common axis. Preferably, only two or three elements are used to simplify the apparatus while still maintaining adequate operational characteristics. In a preferred embodiment, the elements are spaced along the common axis such that a gap exists between the elements. Of course, alternative embodiments wherein elements overlap, yet do not conductively touch, are also within the scope of the present invention. In addition, elements comprising more than one axis, for example, elements comprising two axes, are within the scope of the present invention, of course, the electrical field lines should be perpendicular to each of the axes.

In a preferred embodiment, each element comprises at least one cross-section normal to the common axis wherein the at least one cross-section comprises a shape selected from the group consisting of circular, ellipsoidal, oval, and polygonal shapes. Of course, an element optionally comprises other shapes; however, circular, ellipsoidal, oval and/or polygonal shapes are preferred. In another preferred embodiment, cross-sectional area varies along the common axis. In such an embodiment, the cross-sectional area increase and/or decreases along the common axis. In a preferred embodiment, at least one element comprises a constant cross-section and cross-sectional area.

In a preferred embodiment, at least one electrical field comprises a non-linear electrical field along the common axis. In such an embodiment, the non-linearity optionally comprises a mathematically calculated and/or experimentally derived non-linearity that is useful for affecting charged particles for a particular purpose. For example, in ion mirror embodiments of the present invention, non-linearity serves to provide at least first order focusing, and preferably at least second order focusing.

According to a preferred embodiment, the present invention comprises at least one grid wherein the at least one grid is optionally integral with at least one of the at least two elements. An element optionally comprises a grid at any point along its axis. Likewise, in a preferred embodiment, the present invention comprises at least one plate wherein the at least one plate is optionally integral with at least one of the at least two elements. An element optionally comprises a plate at any point along its axis. In a preferred embodiment, a plate defines at least one aperture, and preferably a single aperture.

In a preferred embodiment, the apparatus comprises a charged particle mirror wherein charged particles enter the apparatus substantially parallel to a common axis, reverse direction and exit the apparatus substantially parallel to the common axis. In a preferred embodiment, the mirror provides for at least first order focusing of charged particles and preferably at least second order focusing of charged particles.

The present invention is not limited to charged particle mirrors, for example, the apparatus optionally comprises a charged particle lens. As disclosed herein, the term ion is used in describing several embodiments; it is understood to one of ordinary skill in the art of physics and/or chemistry that an ion is a charged particle and that the ion embodiments are useful for charged particles in general. Charged particles include, but are not limited to, ions and electrons.

In a preferred embodiment, the inventive apparatus comprises a charged particle zoom lens comprising at least one element movable along said common axis. In such an embodiment, the lens comprises a variable focal length.

In a preferred embodiment, the present invention comprises a single front element for use with a device for affecting charged particles wherein the single front element comprises an increasing cross-sectional area from front to rear. In such an embodiment, this front element further comprises a front plate defining an aperture. According to the present invention, such an embodiment is useful for replacing a grid, for example, a front grid. Of course, embodiments of the present invention described herein optionally comprise a front element comprising an increasing cross-sectional area from front to rear. Furthermore, the increase in cross-sectional area is optionally linear and/or non-linear and/or with changing cross-section shape in addition to dimensions.

According to a preferred embodiment, the apparatus comprises a mirror and/or a lens wherein charged particles enter and exit along a common axis. Such embodiments include apparatus wherein charged particles enter at an angle and exit at another angle and/or the same angle to the common axis. In a preferred embodiment, such angles comprise angles of less than or equal to approximately 15 degrees. Of course, embodiments comprising larger angles are within the scope of the present invention. However, for example, in the case of a mirror, care must be taken that the field is relatively homogeneous in the radial direction encompassed by the angle about the axis, i.e., it is best to use angles that maintain the charged particles within a radially homogenous field region. Angles encompassed by the present invention correspond to angles used in charged particle devices known to one of ordinary skill in the art, for example, mass spectrometer devices. In general, mass spectrometers use angles that are substantially parallel to an ion mirror axis. Radially homogenous field refers to a field that is substantially the same on the axis as in a radial position off that axial point. Experiments presented below demonstrate the balance between radial field homogeneity, ion beam size and resolution in a mass spectrometer.

In a preferred embodiment, the elements of the apparatus comprise an orthogonal arrangement about the common axis. In such an embodiment, a gap of uniform widths is preferably formed between adjacent elements.

In a preferred embodiment, the present invention comprises an ion mirror for mass spectroscopy comprising at least two tube-shaped, electrically conductive elements arranged along a common axis wherein each of the at least two elements comprises a finite length; and at least one voltage source for providing a voltage at each of the at least two elements wherein the provided voltage produces an electrical field comprising field lines perpendicular to the common axis for reflecting ions travelling substantially parallel to the common axis. In a preferred embodiment, the ion mirror provides for second order focusing of an ion beam.

A primary object of the present invention is to improve resolution of mass spectrometers.

A primary advantage of the present invention is the production of off-axis field homogeneity.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

Figure 1:
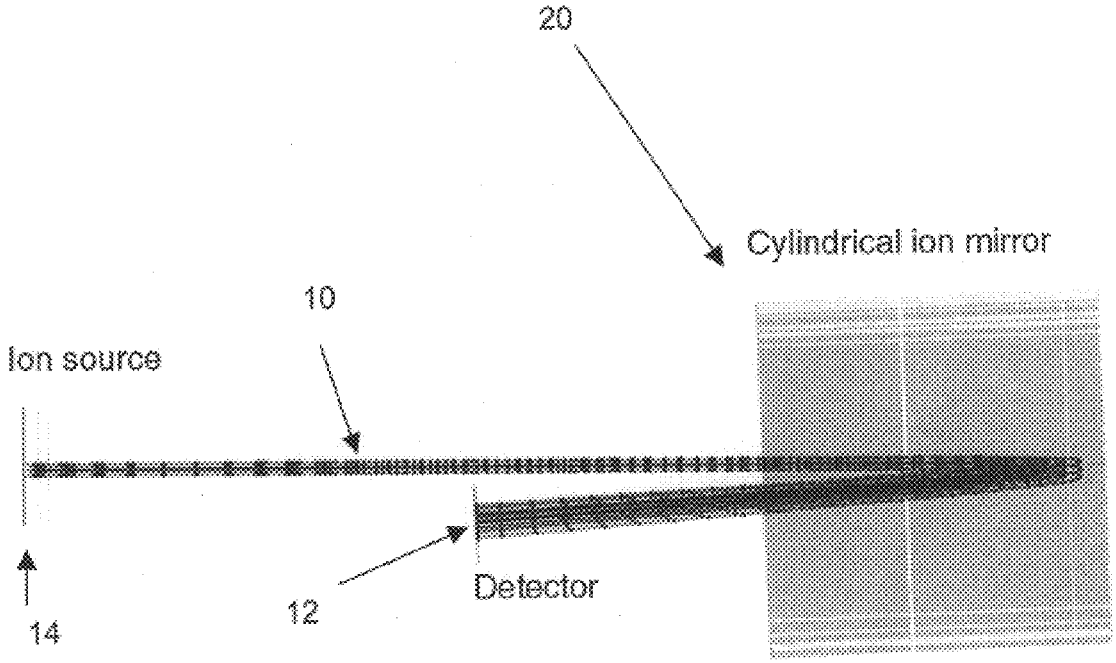
FIG. 1 is a diagram of a preferred embodiment of the apparatus of the invention comprising a cylindrical ion mirror.

DESCRIPTION OF THE PREFERRED EMBODIMENTS (BEST MODES FOR CARRYING OUT THE INVENTION)

The present invention comprises at least one conductive element connected to at least one voltage source wherein the voltage provides for an electrical field. According to a preferred embodiment, the at least one conductive element comprises a tube shape. In a preferred embodiment, the tube comprises a finite length and, for example, a circular, ellipsoidal, and/or polygonal cross-section. Of course, in such an embodiment, the tube dimensions optionally vary with respect to length; thus, a tube optionally comprising an increasing and/or decreasing cross-sectional is within the scope of the present invention.

In a preferred embodiment, the at least one element forms an ion optic or a lens, and preferably an ion mirror. Therefore, the present invention is useful for ion manipulations, such as, but not limited to, focusing and other lens operations. In a preferred embodiment, the invention comprises elements that act to increase and/or decrease the kinetic energy of ions. According to the present invention, the term ion comprises charged particles, including electrons. The present invention is useful alone or in combination with lenses, such as tubular lenses known in the art of ion-based spectroscopy. In general, the present invention is useful in a vacuum, such as, but not limited to, vacuums used in mass spectroscopy.

In a preferred embodiment, the present invention comprises an ion mirror wherein ions enter the mirror along a mirror axis. Along the mirror axis, it is preferred that electrical field lines are substantially parallel, especially between elements if more than one element is used. Of course, an ion mirror of the present invention optionally comprises at least one grid wherein a grid is placed at the front or end of an element and/or between elements, when more than one element is used. In general, the presence of a grid helps to ensure that electrical field lines are parallel to each other and/or parallel to the mirror axis. However, the presence of a gird can reduce ion transmission.

According to a preferred embodiment, the present invention comprises an ion mirror comprising electrical field lines that are substantially parallel along a mirror axis. In addition, the spacing of the field lines provides a non-linear electrical field along the mirror axis wherein the non-linear field provides for at least second order focusing of ions.

In a preferred embodiment, the present invention comprises an ion lens and/or ion mirror comprising elements that comprise cylindrical and/or conical geometry with and without grids for general time-of-flight (TOF) mass spectrometers. Embodiments of such inventive ion mirrors according to the present invention are disclosed in Zhang, J.; Enke, C. G., "A Simple Cylindrical Ion Mirror with Three Elements," *J. Amer. Soc. Mass Spectrom.* (2000). Vol. 11,759 and Zhang, J.; Gardner, B. D.; Enke, C. G., "A Simple Geometry Gridless Ion Mirror," *J. Amer. Soc. Mass Spectrom.* (2000) Vol. 11,765. These two articles are herein incorporated by reference. In another preferred embodiment, the present invention comprises an ion lens and/or ion mirror comprising rectangular elements, preferably for use in TOF-oa mass spectrometers. Such rectangular ion mirror embodiments according to the present invention are disclosed in Zhang, J.; Enke, C. G.; "A Three-element, High Resolution Ion Mirror for Orthogonal Acceleration of TOF Mass Spectrometry," *J. Amer. Soc. Mass Spectrom.* (2000) (in press). This article is herein incorporated by reference.

Cylindrical Embodiments

In a preferred embodiment, the present invention comprises a cylindrical ion mirror that creates an electric field that is non-linear or curved along the flight path axis for general-purpose time-of-flight (TOF) mass spectrometers. This particular "cylindrical" ion mirror embodiment comprises at least one grids, and preferably one or two grids, to improve the radial field homogeneity especially around a mirror aperture. The mirror aperture typically coincides with the beam axis. In a preferred embodiment, the cylindrical mirror comprises three cylindrical elements. According to this embodiment, changes in element dimensions and element voltage are used to create an optimal electric field distribution in the mirror. At first, optimal element dimensions are set, then two parameters related to element voltage are adjusted to achieve the optimum non-linear electric field shape. In a preferred embodiment, the voltages of a middle element and a rear element are adjusted to effect resolving power and the kinetic energy range over which beam focusing is achieved. According to this embodiment, resolving powers of 7,000 and 16,100 have been achieved with kinetic energy variations of 34% and 10.5% respectively.

Results from numerical experiments, or simulations, show that, in a preferred embodiment, the electric field homogeneity in the radial direction enables the use of ion beam diameters up to approximately 15 mm with only modest loss of resolving power. Of course, increasing the mirror diameter further increases the practical ion beam diameter. In a preferred embodiment, the arrival time spread for a single m/z value is narrower than that caused by the turn-around time of ions in a gas-phase ion source. In such an embodiment, the broad energy range over which adequate focus is achieved enables the use of higher extraction fields for turn-around time reduction.

According to cylindrical ion mirror embodiments of the present invention, a cylindrical shape is used to obtain a non-linear electric field along the mirror axial direction. FIG. 1 shows a preferred embodiment wherein the configuration of the ion source comprises a cylindrical mirror with the front grid and an ion detector. According to this preferred embodiment, at least one grid, and preferably one or two grids, is used to improve the homogeneity of the electric field in the radial direction. In this preferred embodiment, the at least one grid is placed where the difference in electric field strength on either side is small. Cylindrical elements have previously been used in a non-focusing (hard) ion mirror that reversed the direction of the ion trajectory, as reported by Scherer et al., Proceedings of the $46^{th}$ ASMS Conference on Mass Spectrometry and Allied Topics, Orlando, Fla., May 31–Jun. 4, 1238 (1998). However, in a preferred embodiment of the present invention, use of cylindrical elements is for a different purpose and for achieving a different result, as set forth herein.

Shown in FIG. 1 is an ion mirror of a preferred embodiment of the present invention. This ion mirror has a front grid but the cylindrical design with two grids or truncated cones with one or two grids are also possible. The diameter of the ion beam shown here is approximately 10 mm. Its diameter at the detector is approximately 25 mm. The distance between the ion source and ion mirror is approximately 700 mm, while that between the ion mirror and the detector is approximately 340 mm. The incidence angle of the ion beam is approximately 2.0°. The voltages of middle and rear elements in the ion mirror are approximately 1247 V and approximately 1896 V, respectively. The angle for the detector is approximately 2.9°. Thus, the flight of the ions is substantially parallel to the axis of the mirror.

An ion beam 10 trajectory is shown in FIG. 1. The ions are emitted from an ion source 14, pass through an ion mirror 20 (comprising three elements) and then to an ion detector 12. The initial ions are evenly distributed in the two-field source. The kinetic energy depends on the initial locations and the diameter of the ion beam 10, a priori knowledge of the initial locations and beam diameter is useful for testing the effect of electric field homogeneity in the radial direction after passage of the ion beam 10 through the mirror 20. The experimental ion beam 10 trajectory shown in FIG. 1 was for 30 ions extracted from the source 14, which represents an adequate number of ions for visualization of the ion beam 10 trajectory. However, more ions are useful for an analysis of flight time and calculation of resolving power. Resolving power was calculated with the total flight time ($t_{total}$) divided by the baseline width ($\Delta t_{total}$) of all ions with the same m/z. According to examples of the cylindrical embodiment of the present invention, a detector 12 diameter of approximately 40 mm was used. The criteria used to evaluate the ion mirror 20 performance were resolving power and beam convergence over a kinetic energy range of interest.

Dimensions of Ion Mirror and Equipotential Line Distributions in Mirror

To demonstrate the use of element dimensions and voltages on an ion mirror, conical and cylindrical shapes were examined. The results of the numerical experiments show that both shapes work well for good performance of broad energy focusing with one or two grids. Results for cylindrical shapes are presented immediately below while results for conical shapes are presented further below. In general, cylindrical shapes, as compared to conical shapes, were easier to fabricate and optimize for practical operation.

Figure 2:
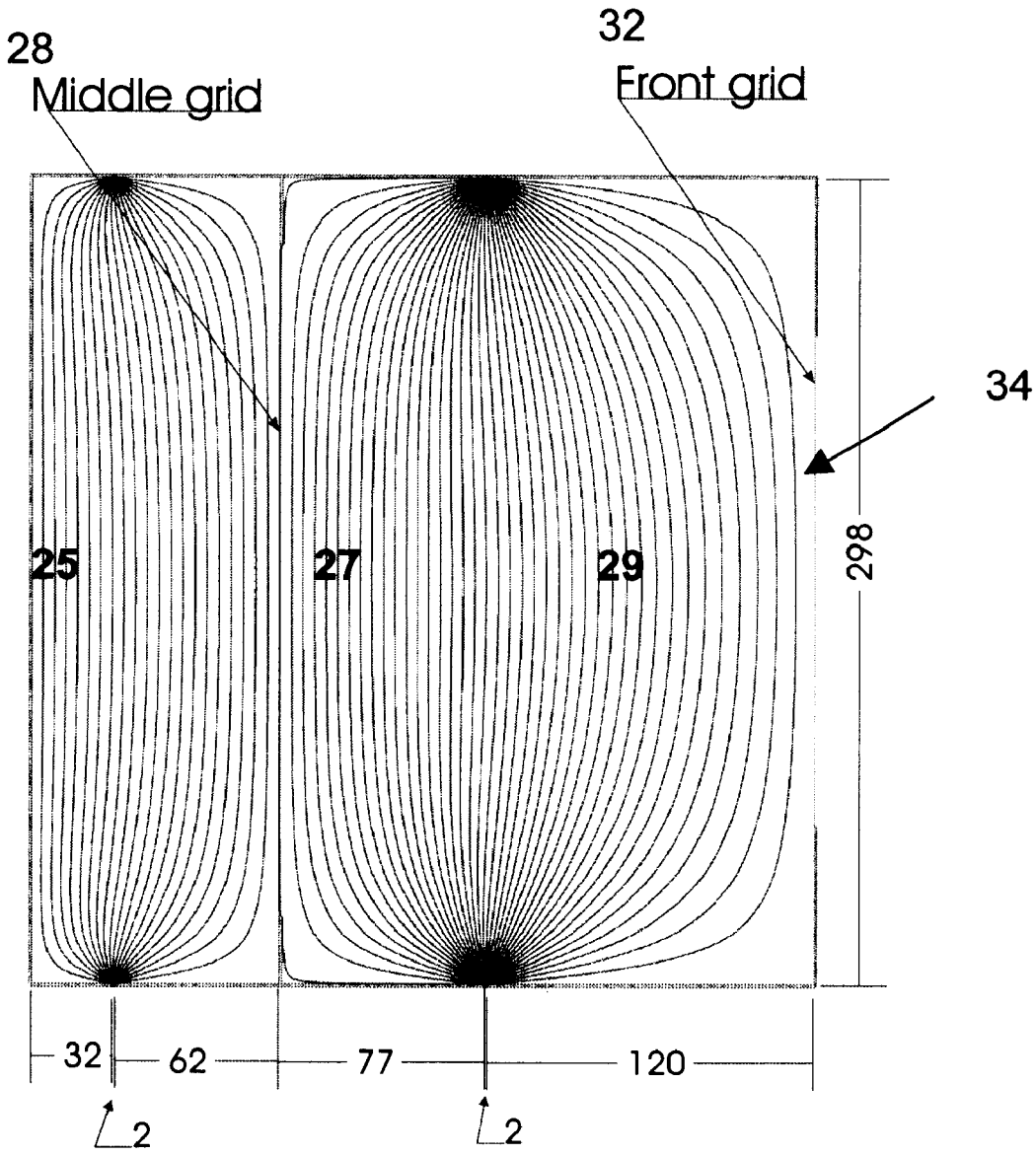
FIG. 2 is a electrical field contour plot showing equipotential line distributions of the cylindrical shown in FIG. 1 with two grids wherein units are given in mm.

A contour plot is shown in FIG. 2. This plot shows the geometry, dimensions and the equipotential line distribution of a cylindrical mirror according to a preferred embodiment of the present invention. As shown in FIG. 2, the mirror comprises a rear element 25, a middle element 27, a front element 29, a middle grid 28 and a front grid 32. The middle grid 28 is positioned at an axial distance of approximately 199 mm from the front grid 32. Equipotential lines are shown as emanating from a gap (an annular region in three-dimensional space) distal to the front grid 32 (gap between front 29 and middle 27 elements) and from a gap (an annular region in three-dimensional space) distal to the middle grid 26 (gap between middle 27 and rear 25 elements). According to this particular example, a turn around region exists in depths greater than approximately 100 mm. While this embodiment shows a middle grid 28 in the mirror, results show that the middle grid 28 is optionally removable without affecting the electric field distribution because the field change in vicinity of the middle grid is relatively small and therefore, for the purposes of typical mass spectroscopy, negligible. The front grid 32 is required to make the equipotential lines flat in the vicinity of an aperture 34 in the front grid 32. The dimensions chosen achieve an electric field that is non-linear along the axial direction and homogeneous in the radial direction. Generally, the larger the mirror diameter the more homogeneous the electric field in the radial direction. Simulations for the cylindrical embodiment with and without a middle grid 28 were examined. In general, the presence of the middle grid 28 has little effect on the resolving power but does have a slight effect on the optimum voltages for the middle element 27 and rear element 25.

Electric Field Distribution Along the Ion Mirror Axial Direction

Figure 3:
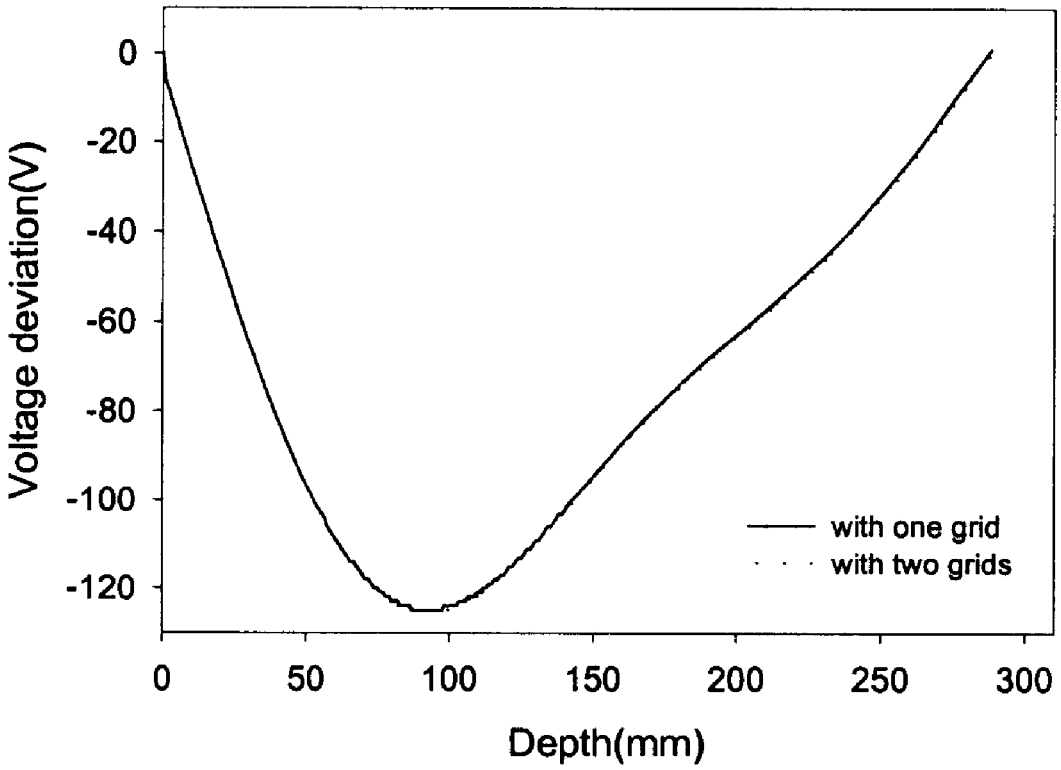
FIG. 3 is a plot of electrical field of a preferred embodiment along the mirror axial direction wherein the vertical coordinate is the voltage deviation ($E_{dev}$) from the linearity value ($E_{Lin}$) and the horizontal coordinate is the depth along the mirror axis.

For this particular example of the cylindrical embodiment, if direct electric field distribution is plotted versus axial depth, the field lines are only slightly curved in the planes parallel to the entrance grid. FIG. 3 shows optimized non-linear electric fields achieved by a cylindrical embodiment of the present invention. The results are plotted as the non-linear voltage deviation from a corresponding linear value. The optimum field contours are nearly the same with and without the middle grid 28, as represented by the solid curve for results of an embodiment with one grid and the dotted curve for results of an embodiment with two grids. These two curves are nearly indistinguishable. Thus, in a preferred embodiment, the middle grid is optional. As shown in FIG. 3, a slight field curvature exists in the turn-around region, generally depths greater than approximately 100 mm: this curvature provides for higher order focusing, e.g., second-order focusing. While this example presents an ion mirror comprising second order focusing, higher order focusing is also within the scope of the present invention. To achieve focusing higher than second order, of course, the inventive mirror optionally comprises more than two grids. In addition, according to a preferred embodiment, second order energy focusing is achieved over different kinetic energy ranges.

Electric Field Homogeneity Study in the Radial Direction

Figure 4:
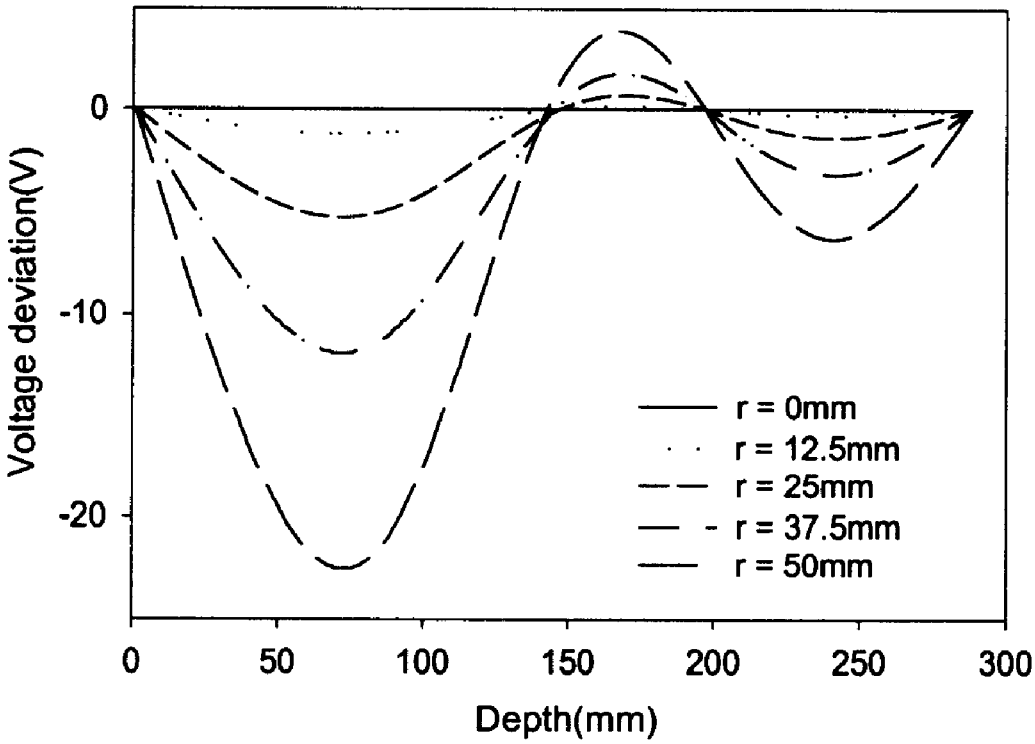
FIG. 4 is a plot of homogeneity of the electric fields of a preferred embodiment in the radial direction (the voltage deviation from the value on the mirror axis)

Tests were performed to examine radial, or off-axis, homogeneity of the electric field in a preferred embodiment of the cylindrical mirror of the present invention. FIG. 4 shows voltage deviation from axial voltage for five trajectories parallel to the mirror axis. The distance of each trajectory from the axis is given as radius r in mm. According to the results, the trajectory represents a single point at a given radius or alternatively multiple points at a given radius or diameter. Thus, the results support conclusions in terms of ions having a trajectory within a given radius around the mirror axis. In other words, the given radius represents, for instance, an ion beam comprising a given diameter that is centered on the mirror's axis. All of the results presented herein assume that the ion beam is centered on the axis of the mirror.

In the region within a 25 mm diameter (r=12.5 mm), e.g., an ion beam having a 25 mm diameter, the maximum voltage deviation is less than 1V along the entire axis of the ion mirror. As the beam diameter is increased, shown as larger radii in FIG. 4, the voltage deviation increases gradually and then rapidly. The relationship is non-linear and, in general the inhomogeneity asymptotes to approximately zero as beam dimensions decrease. The decrease in resolving power with increasing beam diameter follows this same patter. Increasing the diameter of the ion mirror results in the improvement in the off-axis homogeneity and hence the resolving power for a given beam diameter.

Flight Time Analysis

According to preferred embodiments of the cylindrical mirror of the present invention, changing voltage applied to the middle and rear elements optimizes the electric field shape and thus the resolving power for a given kinetic energy range. Resolving power is the criterion used to evaluate ion mirror performance. The optimized conditions depend on the mirror configuration.

Figure 5:
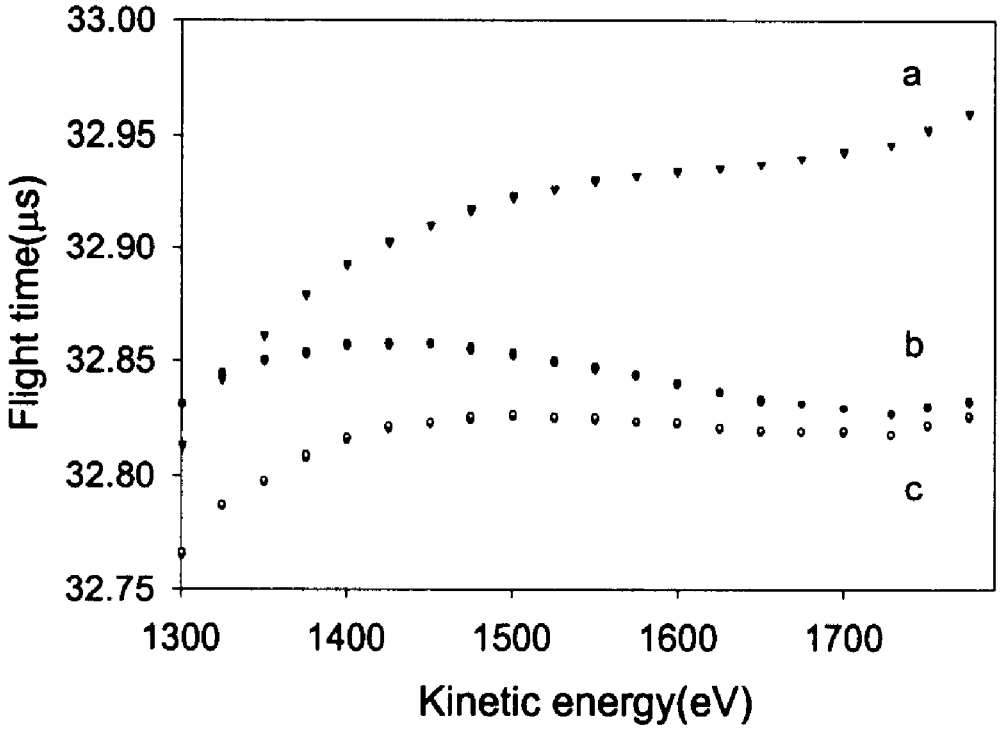
FIG. 5 is a plot of flight time distribution as a function of ion kinetic energy for a cylindrical ion mirror with one grid of the present invention wherein the conditions for the distributions a, b and c are as follows: a. $V_{middle}$=1247V, $V_{rear}$=1895V; b. $V_{middle}$=1240V, $V_{rear}$=1900V; c. $V_{middle}$=1247V, $V_{rear}$=1905V.

The results of changing the voltages of the middle and rear elements are shown in FIG. 5, in which the flight time distribution over a kinetic energy range from 1300 eV to 1790 eV is plotted. The energy differences of the ions result from different starting positions in the source. The best flight time distribution normally has a shape of a flattened "S" over a given energy range. Typically, the "S" starts at a minimum near lower energy values, rises to a maximum with increasing energy values, declines from this maximum while approaching higher energy values and then reaches another minimum from which it rises with increasing energy values (see curves labeled "b" and "c" in FIG. 5). The shape of this distribution is adjustable by changing element voltages. For example, if a distribution of flight time over a kinetic energy range has a "\" shape (wherein the arrival time decreases as the ion kinetic energy increases) with a given set of elements voltages, a flattened "S" distribution can be achieved by increasing the voltage of the middle element or decreasing the voltage of the rear element. On the other hand, if a distribution of flight time over a kinetic energy range has a "/" shape (wherein the arrival time increases as the ion kinetic energy increases), a flattened "S" shape can be achieved by decreasing the voltage of the middle element and/or increasing the voltage of the rear element. In order to get high resolving power over a particular kinetic energy range, a flattened "S" shape distribution of flight time over this range is preferred.

The central flat portion represents the best kinetic energy range of ions focusable by the mirror. Tuning the voltage results in a central portion that is as flat as possible over a desired kinetic energy range. The width of the flight time packet $\Delta t_{total}$ is used to calculate the resolving power. For example, the scattered curve, distribution (c) in FIG. 5, is almost flat to within approximately 2 ns over a kinetic energy range of about 200 eV near the central portion in distribution (c) when $V_{middle}$ is approximately 1247 V and $V_{rear}$ is approximately 1905 V, but the resolving power over the full kinetic energy range present in distribution (c) is not optimum. Curve (b) is a nearly optimum distribution for the full kinetic energy range because of a wide flattened "S" shape; however, the width of the flight time pocket is broader than that for a narrow kinetic energy range and some of resolving power is sacrificed.

According to the results shown in FIG. 5, when the middle grid in these particular cylindrical embodiments is removed, the optimum performance remains the same. However, the optimization of voltage adjustments for single-grid embodiments is slightly more difficult to achieve as the adjustments are less interactive That is, a change in one element's voltage is less likely to affect the optimum voltage for another element.

Figure 6:
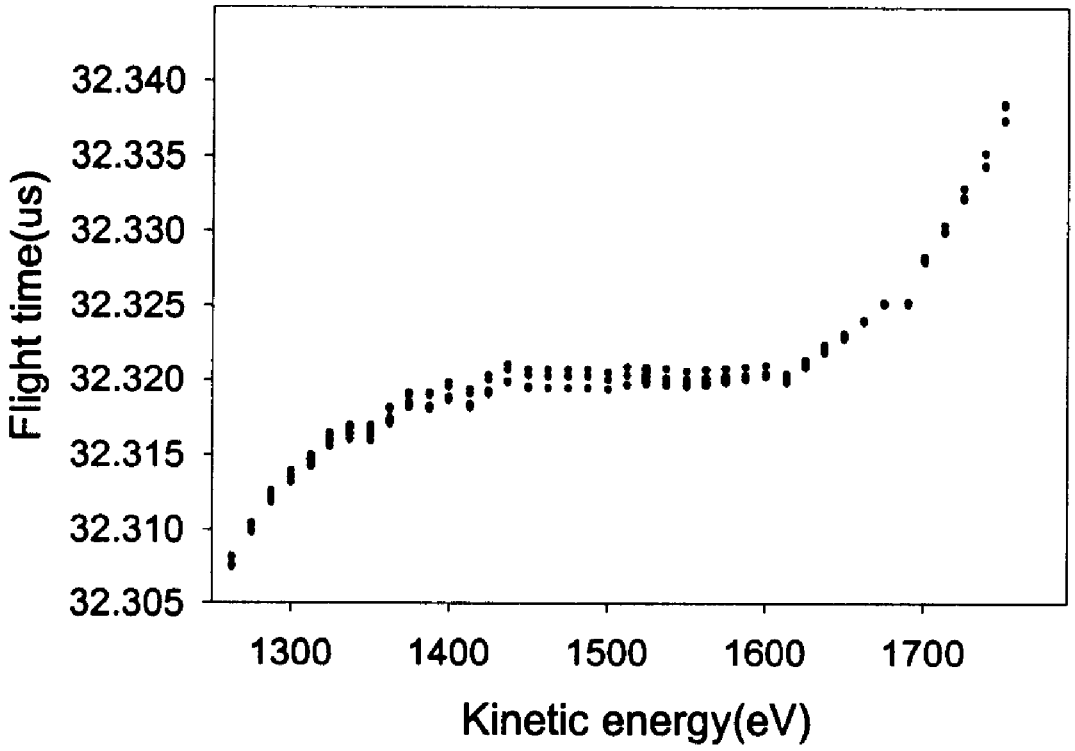
FIG. 6 is a plot of flight time distribution of a cylindrical ion mirror of the present invention without a middle grid wherein the voltages of the middle and rear electrodes are approximately 1247 V and approximately 1897 V respectively and the beam diameter of 240 ions is approximately 10 mm.

FIG. 6 is an example of an optimized flight time distribution as a function of ion kinetic energy for the cylindrical ion mirror without the middle grid. The increase in the distribution of arrival times for any given kinetic energy over the mirror with the middle grid (FIG. 5) is due to an increase in radial inhomogeneity. The width of the flight time packet is approximately 2 ns over the kinetic energy range from approximately 1438 eV to approximately 1625 eV.

Figure 7:
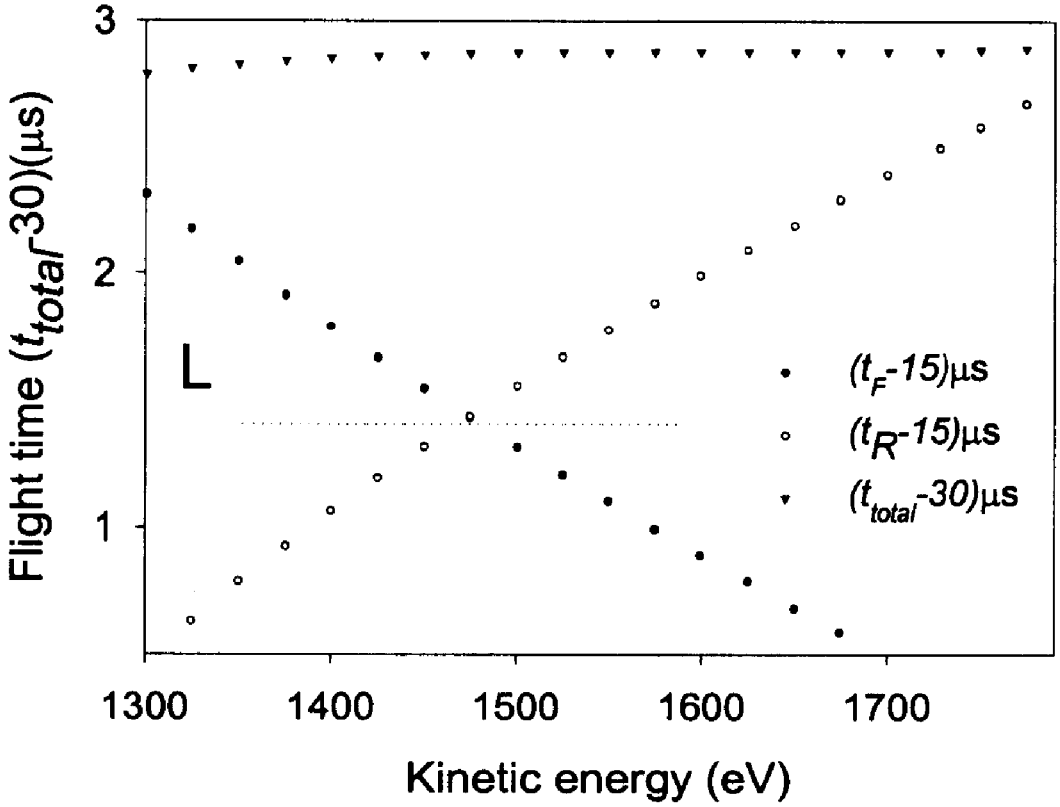
FIG. 7 is a plot of flight time distribution in a field-free region and in an ion mirror comprising a cylindrical ion mirror of the present invention with two grids wherein L is a straight line parallel to the horizontal axis.

The total flight time ($t_{total}$) includes two parts: time spent in the ion mirror ($t_R$) and time spent in the field-free region ($t_F$). ($t_{total}=t_R+t_F$). Of course, the relative values of $t_R$ and $t_F$ are a function of the kinetic energy. The sum of these two components of flight time should be constant for perfect focusing. FIG. 7 shows the total flight time distribution of a cylindrical ion mirror with changing electric field distribution for ions with different kinetic energies. In order to fit all data on the same graph, the values are plotted minus the constants shown. In FIG. 7, a line labeled L has been drawn through the point for which $t_R=t_F$. Ideally, the line for $t_{total}$ is parallel to L over a large kinetic energy range. The symmetry around L shows the compensation of flight times in the mirror and field-free regions. This detailed data analysis demonstrates adequate compensation in the middle of kinetic energy range. The average $t_R/t_{total}$ is about 50% in this cylindrical ion mirror.

Mass Resolving Power

Figure 8:
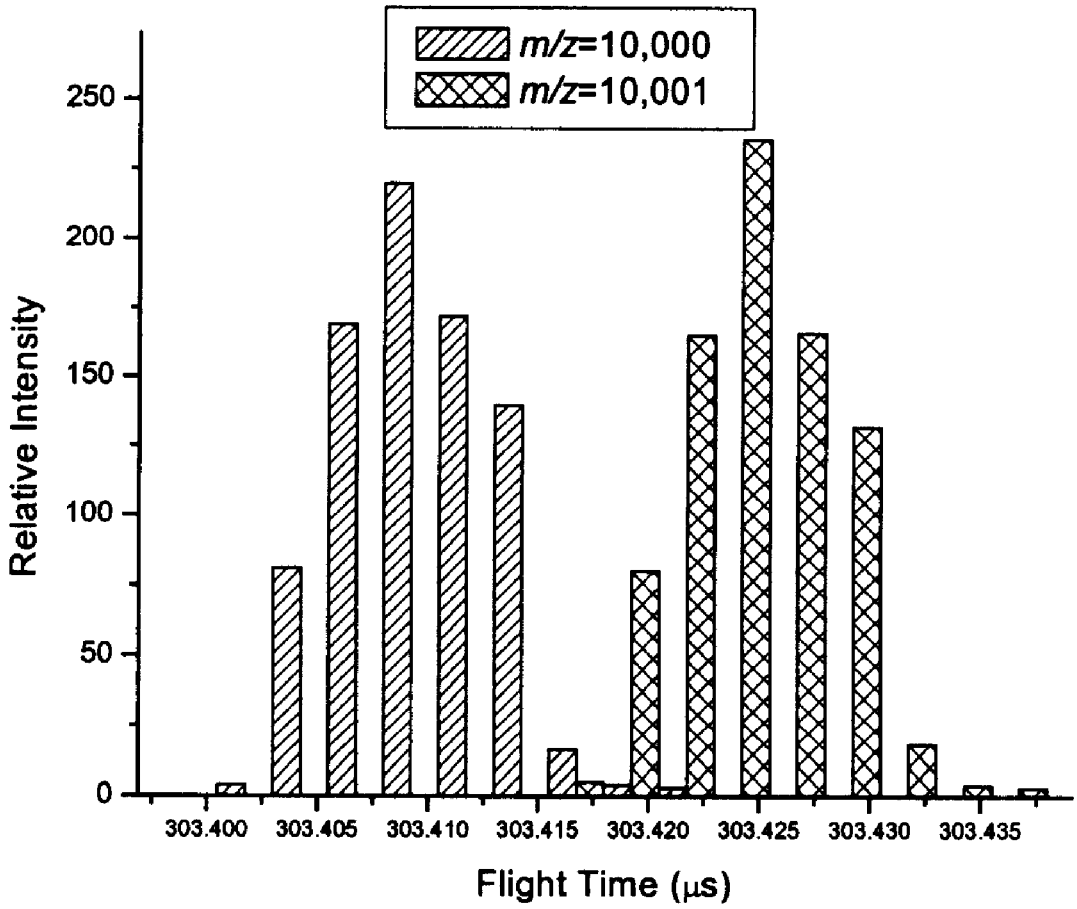
FIG. 8 is a histogram plot from numerical experiments of a spectrum of ions with adjacent m/z values over 300 eV kinetic energy range.

In numerical tests one thousand and four hundred ions were used to predict arrival time spectra. All ions were evenly distributed in the ion source without any weighting factor thereby creating a condition that represents a worst case scenario for ion distribution in the ion source. Normally, ions in an ion source are not evenly distributed in that more of the ions are concentrated near the source's center. Arrival times were recorded over certain kinetic energy ranges and plotted as a histogram of number of ions versus arrival time for an approximately 300 eV kinetic energy range, as shown in FIG. 8. The results presented in FIG. 8 show that the ions were approximately equally divided between two adjacent m/z values. A narrower kinetic energy range results in a higher resolving power; therefore, resolving power depends on kinetic energy.

Figure 9:
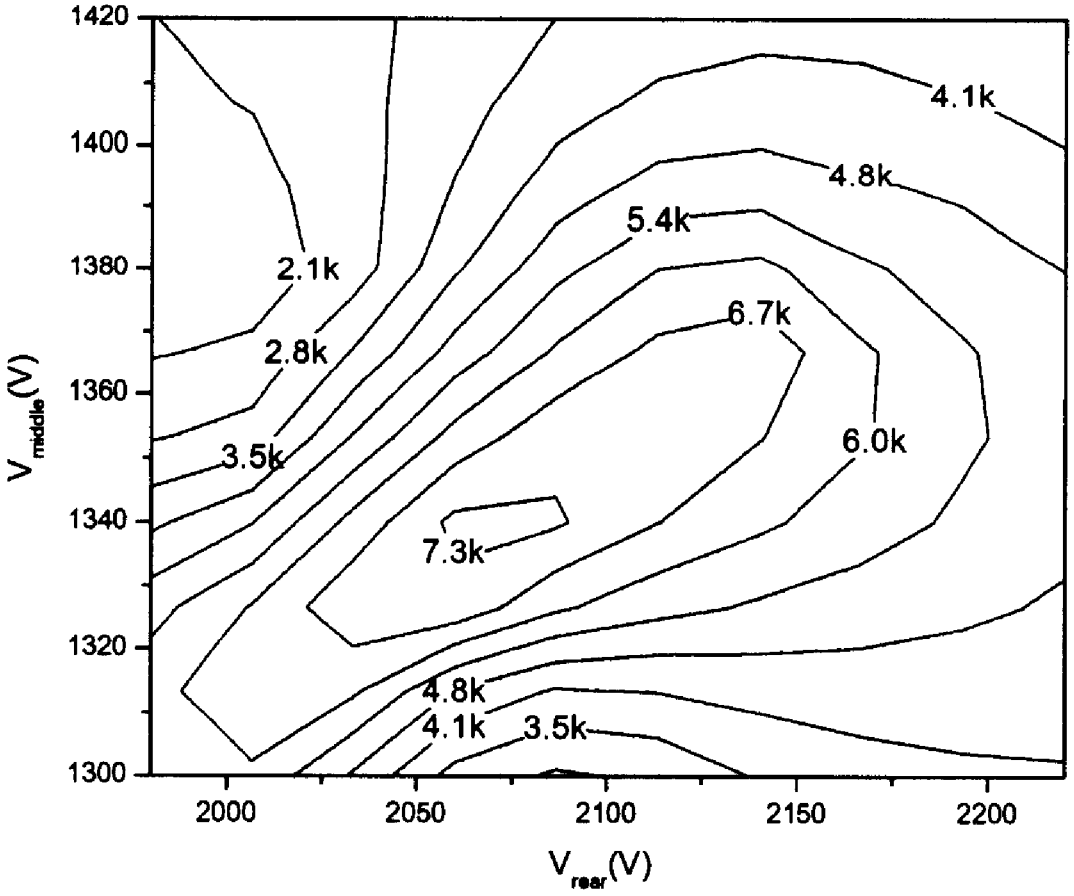
FIG. 9 is a contour plot that shows the effect of changing voltages of middle and rear elements over a given range.

Additional tests were performed wherein fifty optimizations were conducted with different combinations between the voltages of the middle and rear elements. Results of these experiments, showing the relationships of resolving power and element voltages, are presented in FIG. 9. The plot of FIG. 9 shows the voltage optimization of the middle and rear elements over a kinetic energy of approximately 397 eV. Results demonstrated that many combinations of middle and rear element voltages exists for yielding a best resolving power. The best resolving power was over approximately 7,300 for the kinetic energy range of interest. Such plots are useful to guide instrument design and characterization of new instruments.

Limitations of Non-Mirror Factors

To further characterize the test results of a flight time packet for a cylindrical ion mirror embodiment of the present invention, additional flight time parameters were examined. In particular, the results presented above were compared to predicted flight time variance with other flight time broadening parameters. The most relevant of the parameters examined was for a gaseous ion source and its corresponding turn-around time caused by thermal motion of particles in the gaseous ion source. The thermal motion of gaseous ions in an ion source gives rise to the turnaround effect when they are accelerated out of the source. The turn-around time is a fundamental limitation in the achievable mass resolution.

This test was characterized, without applying extraction voltages, such that charged particles had thermal motions in all directions and that examination of two of the directions (along and opposite the extraction field direction) would give adequate results. At first, ions moving opposite the extraction direction move backward until they are retarded to zero velocity. Then they are accelerated in a forward direction. When these ions return to their original position, they have their original velocity but now in the forward direction.

A static ion mirror cannot correct for the period of time that is lost as backward moving ions turn around in the source. Turn-around times from numerical tests of a two-field ion source are given in Table 1 below. The temperature used for the experiments was 500 K and m/z was 100 u for different extraction field intensities. Both the most probable velocity and root mean square velocity were used to calculate turn-around time. The most probable velocity is low and the root mean square velocity is high. The range represents the original velocity distribution limits of charged particles in thermal motions. Increasing the extraction field strength reduces turn-around time. An increase in extraction field strength, however, increases the kinetic energy range over which focusing is required. In practice, a compromise is made that balances these two factors. In general, having a mirror with wide energy-range focusing is very useful.

TABLE 1

Turn-around time of ions with different extraction field strengths

| E = 600 V/cm | E = 900 V/cm | E = 1200 V/cm |
|---|---|---|
| t = 10.0 to 12.2 ns | t = 6.7 to 8.1 ns | t = 5.0 to 6.1 ns |

Besides turnaround time, several other factors limit practical mass resolution. For example, inhomogeneity in the source electric field and inhomogeneity of the electric field in the vicinity of grids can contribute to an arrival time spread.

Feasibility for Wider Ion Beam

All the above numerical tests were performed using an ion beam having an approximately 10 mm diameter and a reflectance angle of 2.0° from normal. Numerical experiments were performed using a larger diameter ion beam to test the performance of cylindrical ion mirrors of a preferred embodiment of the present invention. Results for an approximately 15 mm diameter beam are compared with results for an approximately 10 mm beam in Table 2 below.

TABLE 2

The ion kinetic energy variations for different resolving powers with different ion beam diameters (d)

| | R (d = 10 mm) | R (d = 10 mm) | R (d = 15 mm) |
|---|---|---|---|
| Design with 2 grids | 3 K/24.5% | 16.1 K/10.5% | 10.9 K/10.5% |
| Design with 1 grid | 3 K/24.5% | 16.1 K/10.5% | 10.9 K/10.5% |

Not shown in Table 2, a narrower ion beam (d of approximately 5.5 mm) was also tested; however, the results did not show any improvement in resolving power over the results for a beam with a diameter of approximately 10 mm. The resolving powers were approximately the same for the configurations with and without middle grids. For an increase of the ion beam diameter, or reflectance angle, the resolving power decreased. This decrease was caused by the increase of electric field inhomogeneity in the radial direction, which in turn broadens the width of flight time packet.

The concept of using the dimensions and voltages on ion mirror enclosures rather than diaphragms is also applicable to variations like truncated cones and rectangular boxes, which, according to the present invention (as described below), also provide adequate non-linear electric fields. According to a preferred embodiment, ion mirrors comprise a front grid for obtaining better radial homogeneity of the electric field around the grid. An optional additional element, or elements, may affect both the resolving power and the flight path for fitting different optical systems. As shown in the experiments, for preferred embodiments of the cylindrical ion mirror, very narrow peak widths are generated for accurate mass measurement. Furthermore, the results for two element embodiments show that the best resolving power depends on ion kinetic energy range and voltages of the middle and rear elements.

Conical Embodiments

A gridless embodiment of a cylindrical ion mirror was examined to create an electric field that was non-linear in the axial direction and nearly homogeneous in the radial direction. Gridless embodiments comprise at least one chamber, and preferably one or two chambers, that consists of a truncated cone. This particular "conical" embodiment of the present invention yields ion mirrors with improved energy focusing over conventional single-field and multiple-field mirrors. Conventionally, ion mirrors with non-linear field gradient use multiple diaphragm elements and to which distinct voltages are applied. In contrast, the conical embodiment of the present invention, provides optimized non-linear field distributions that are achieved through shaping, for example, only two or three elements and applying only one or two voltages to the elements. The conical embodiments presented herein offer high resolving power and low ion dispersion. Numerical experiments, referred herein as SIMION simulations, of performance from the ion source to the detector demonstrate resolving powers of approximately 11,000 and approximately 1,750 for ions with kinetic energy variations of approximately 7.5% and approximately 23.6%, respectively.

Perfect compensation for ion kinetic energy differences requires a complex electric field shape in an ion mirror. It is well accepted that the ideal mirror electric field should be non-linear in the mirror axis direction and homogeneous in the radial direction. Practical ion mirrors can be divided into two groups: those with grids and those without grids (gridless). Gridless ion mirrors have the advantages of improved ion transmission but the homogeneity of the electric fields in the radial direction is typically compromised. Inhomogeneity in the radial (or off-axis) direction causes ion dispersion and temporal defocusing. As mentioned in the Background section above, non-linear electric fields have been accomplished by using many diaphragms, each of which must be in precise position relative to the others and have the correct applied voltage. Such ion mirrors are expensive to construct and difficult to optimize and maintain. In addition, the conventional staged designs have two or more regions with significantly different electric field intensities. These regions are generally separated from the flight path and from each other by metallic grids stretched across the diaphragms. The degree of distortion caused by the grids is directly related to the change in the field strength on either side of the grid. These diaphragm configurations also suffer from the disadvantage that the inside electric field is not perfectly shielded from surrounding electric fields.

Figure 10:
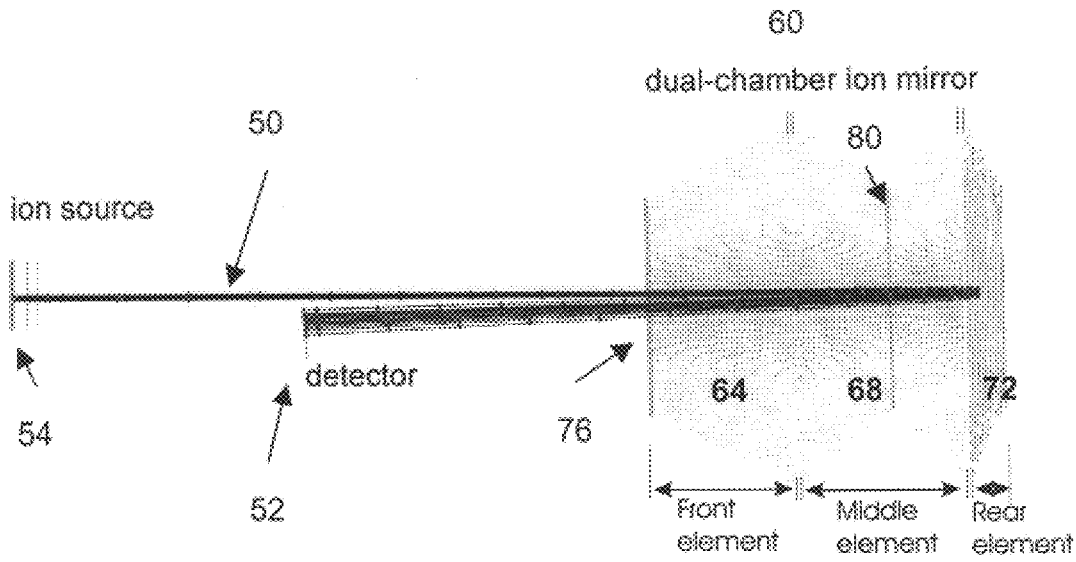
FIG. 10 is a diagram of a preferred embodiment of the present invention comprising a front element comprising a cross-sectional area that increases from front to rear wherein an ion trace is shown from a two-field ion source wherein 120 ions are divided into 6 groups, each group consisting of 20 ions evenly distributed along each line and wherein ions are not placed closer than 1 mm from each end of the ion source, ion beam diameter is approximately 5.5 mm and voltages are relative to the field-free region.

Gridless, non-linear ion mirrors of the conical embodiment of the present invention yield high resolving power for general time-of-flight mass spectrometers. According to this particular conical embodiment, the number of elements used is near minimal. Ion trajectories 50 for a 3-element gridless ion mirror 60 are shown in FIG. 10. This ion mirror comprises a front element 64, a middle element 68 and a rear element 72. Note that the middle element 68 comprises both increasing and decreasing cross-sectional area. The front plate 76 comprises a gridless aperture. The three elements are formed from truncated cones. The middle element 68 has another plate comprising a gridless aperture 80 at its minimum diameter. Results obtained from numerical experiments performed with the ion trajectory modeling program SIMION 7(beta) demonstrated that a desired electric field is achieved by shaping the elements and adjusting their voltages to meet the requirements of different ion optical systems.

Figure 11:
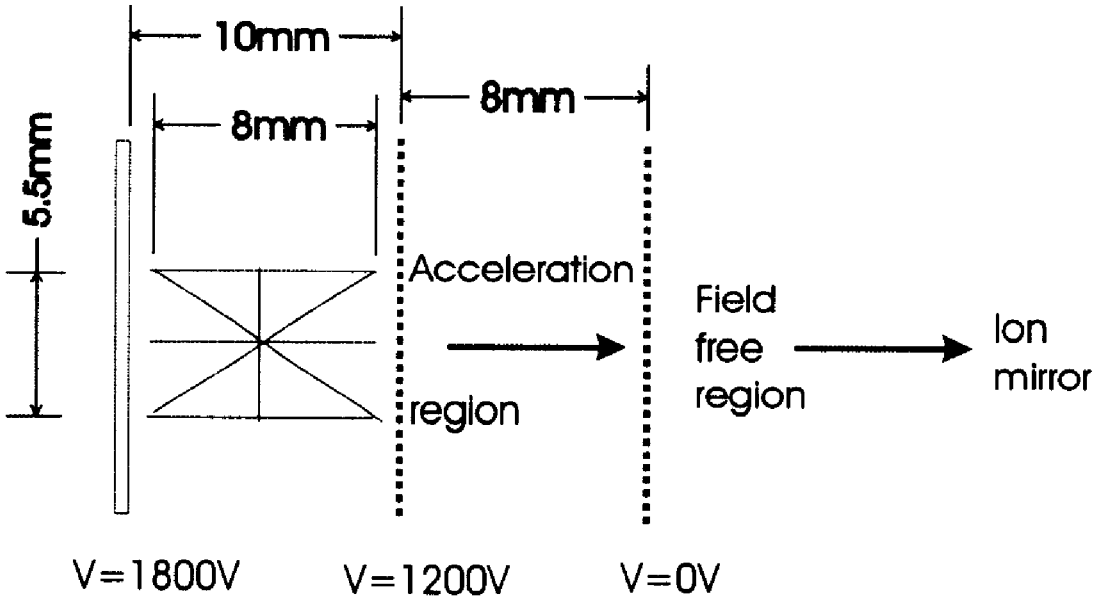
FIG. 11 is a diagram of an ion source.

As mentioned, the modeling program SIMION 7 (beta) was used to evaluate the electric field distribution, field homogeneity, and resolving power of conical ion mirrors of the present invention. The ion source used in the modeling was of exactly the same dimensions as that used in a prior study of two-field segmented-ring-source (SRS). See Ji, Q.; Davenport, M. R.; Enke, C. G.; Holland, J. F., *J. Amer. Soc. Mass Spectrom.*, 7, 1009 (1996). The initial positions of 120 ions were evenly distributed along the mirror axis lines as shown in FIG. 11. In FIG. 11, 20 ions are represented along each line. The accelerating field intensity was approximately 600 V/cm and the distance between two electrodes was approximately 10 mm. Ions were initially distributed in the region of approximately 8 mm by approximately 5.5 mm between the two electrodes. The diameter of the ion beam was approximately 5.5 mm for the numerical experiments.

Total flight times were recorded and used to calculate the resolving power of a particular conical embodiment of the ion mirror. Over a given kinetic energy range, the width of the flight time packet ($\Delta t_{total}$) is the maximal difference of the total flight time for all ions of the same m/z. The total flight time ($t_{total}$) is the average flight time of ions of the same m/z. The resolving power (R) was calculated by $R=t_{total}/\Delta t_{total}$. This corresponds to the resolving power with baseline separation between the peaks of two adjacent m/z values. Voltage deviation from the ion mirror center was used to demonstrate field homogeneity and the ratio of the diameters of entrance and exit ion beams was used to show dispersion.

Ion Mirror Geometry, Dimensions and Electric Field Distribution

Figure 12A:
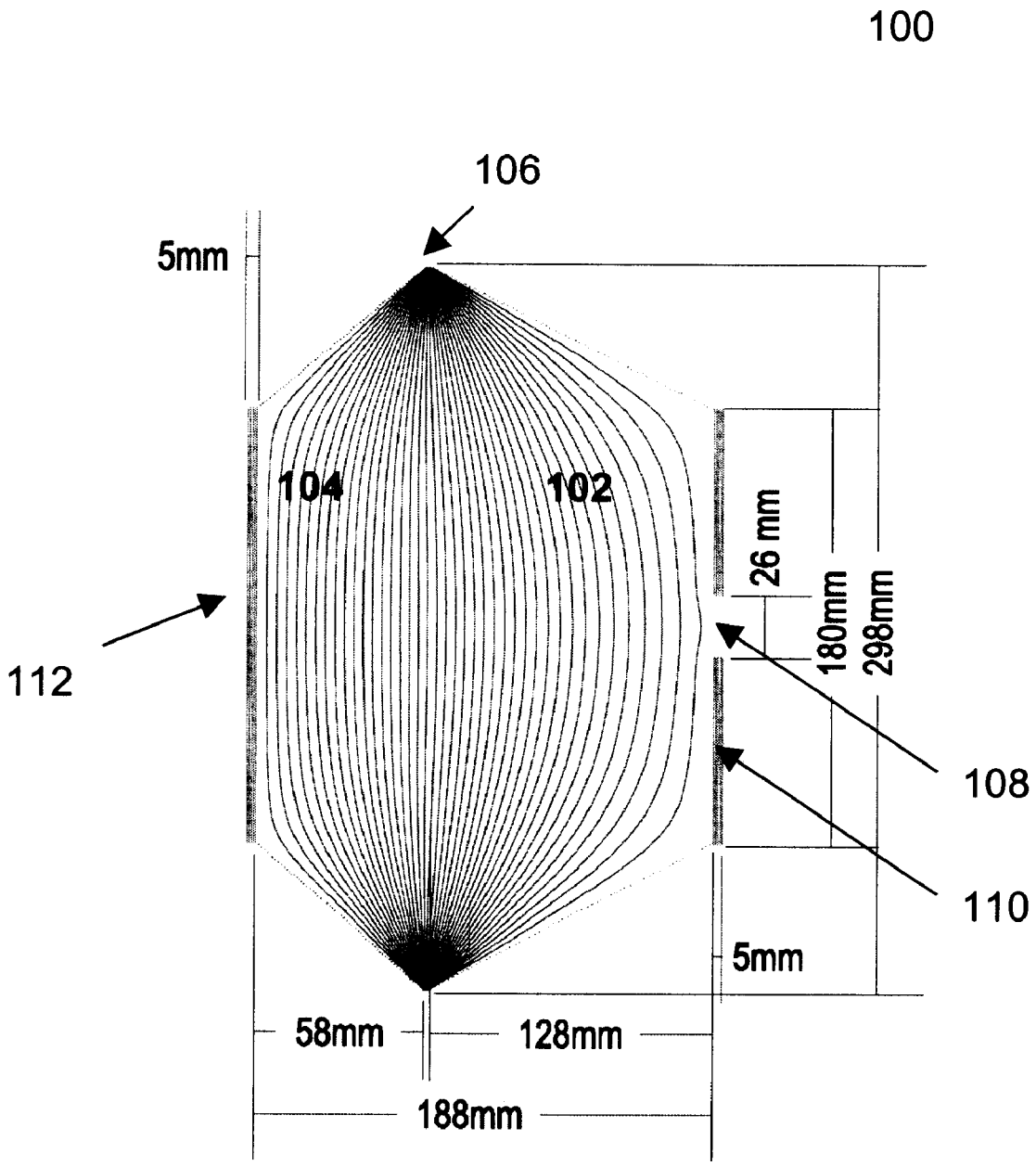
FIG. 12*a* is a diagram showing the geometry, dimensions and equipotential lines of a gridless mirror comprising a single-chamber ion mirror wherein the extent of the radial inhomogeneity is seen in the curvature of the equipotential lines.
Figure 12B:
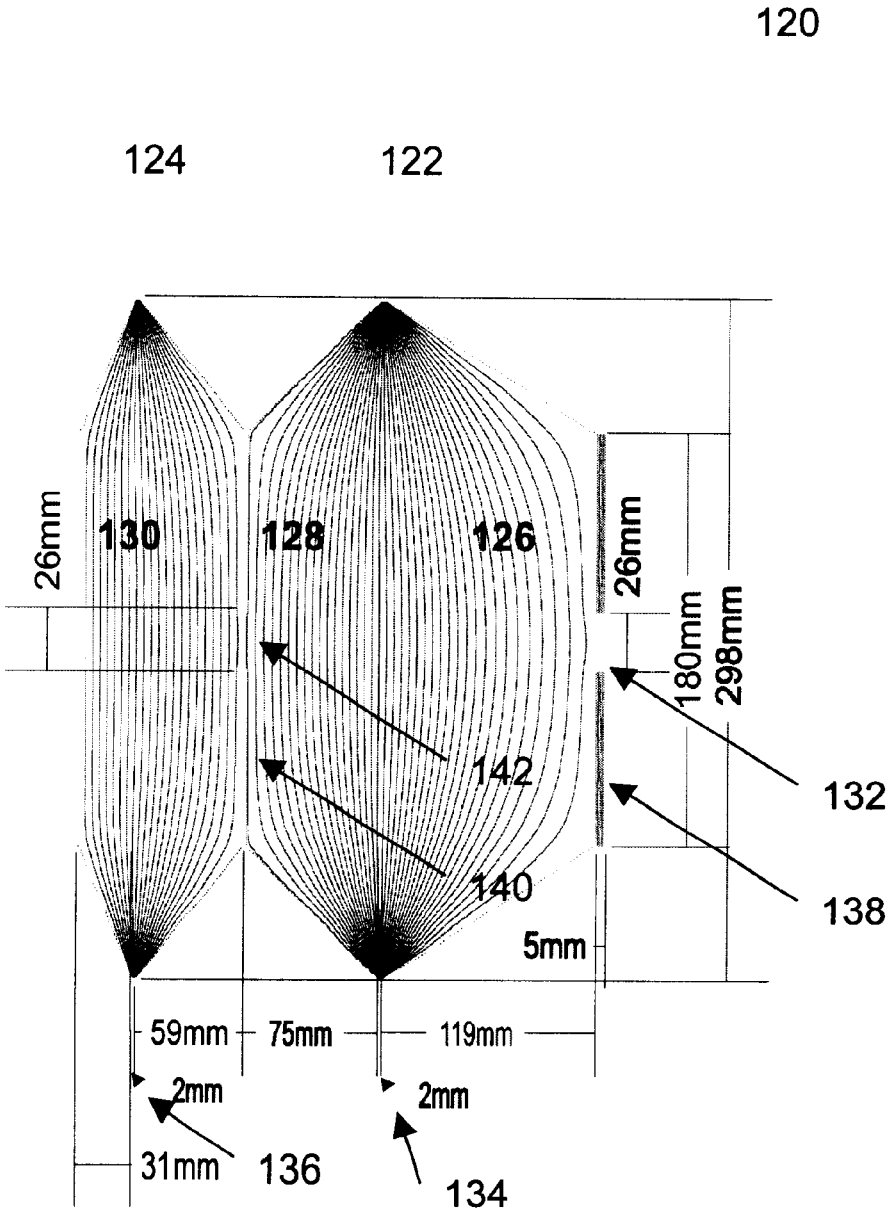
FIG. 12*b* is a diagram showing the geometry, dimensions and equipotential lines of a gridless mirror comprising a dual-chamber ion mirror wherein the extent of the radial inhomogeneity is seen in the curvature of the equipotential lines.

According to a preferred conical embodiment of the present invention, to achieve a non-linear gridless ion mirror with a homogeneous electric field in the radial direction, the minimum possible number of elements is selected. In a preferred embodiment, a single-chamber ion mirror comprises two truncated cone elements while in another preferred embodiment, a dual-chamber ion mirror comprises three elements. Both embodiments produce curved or non-linear electric field shapes with moderate homogeneity in the radial direction. Both embodiments also provide high resolving power for ions with a broad kinetic energy range. FIGS. 12*a* and 12*b* show the shapes of the mirror elements used for numerical experiments of these two particular embodiments. FIG. 12*a* shows a single-chamber (two element) embodiment and FIG. 12*b* shows a dual-chamber (three element) embodiment. These two embodiments do not comprise grids on any of the elements; however, each of the embodiments comprises at least one aperture.

FIGS. 12*a* and 12*b* also show the dimensions and the equipotential lines of the single-chamber and dual-chamber gridless ion mirror embodiments, respectively. FIG. 12*a* shows the dimensions of a single-chamber embodiment, which were used in performing numerical experiments. As shown in FIG. 12*a*, the ion mirror 100 comprises a chamber comprising a front element 102 and a rear element 104 comprising a maximum depth of approximately 188 mm and a maximum diameter of approximately 298 mm. The front of the chamber comprises an aperture 108 in a front plate 110 of the front element 102 wherein the aperture 108 comprises a diameter of approximately 26 mm. Electrical field lines are shown emanating from a gap between the front element 102 and the rear element 104. This particular embodiment, as shown, also comprises a rear plate 112.

As shown in FIG. 12*b*, the ion mirror 120 comprises a front chamber 122 and a rear chamber 124. The ion mirror comprises a front element 126, a middle element 128 and a rear element 130. For purposes of numerical experimentation, the front chamber 122 comprises a maximum depth of approximately 196 mm and a maximum diameter of approximately 298 mm while the rear chamber 124 comprises a maximum depth of approximately 92 mm and a maximum diameter of approximately 298 mm. A front plate 138 of the front element 126 comprises an aperture 132 wherein the aperture 132 comprises a diameter of approximately 26 mm. A rear plate 140 comprising a rear aperture 142 comprising a diameter of approximately 26 mm is also present and positioned in the middle element 128 between the front chamber 122 and rear chamber 124.

In each embodiment shown (see FIGS. 12*a* and 12*b*), 60 equipotential lines are shown to exhibit the field distribution. In FIG. 12*a*, field lines are shown emanating from the gap 106 between the front element 102 and the rear element 104. In FIG. 12*b*, field lines are shown emanating from the gaps 134, 136 between the front and middle elements 126, 128 and between the middle and rear elements 128, 130, respectively. These lines represent the output from numerical experiments performed with the SIMON 7 (beta) modeling package. The particular shape of each embodiment creates non-linear electric fields. As shown in FIGS. 12*a* and 12*b*, the equipotential lines in the off-axis direction are predominately parallel to each other, an indication of homogeneity in the off-axis direction.

As shown in the results presented in FIGS. 12*a* and 12*b*, a bubble exists around the apertures 108 (FIG. 12*a*), 132 (FIG. 12*b*) of each ion mirror. The bubble size is dependent on the thickness of front plate 110 (FIG. 12*a*), 138 (FIG. 12*b*). With an increase in the thickness, the front equipotential lines become flatter, but no further increase in flatness can be achieved by making the front plate thicker than approximately 5 mm.

For the single-chamber ion mirror 100, there is only one variable (the voltage on a rear element 104) if the dimensions are fixed, but there are two variables in the dual-chamber ion mirror 120 and therefore it provides more flexibility in adjusting field distributions. The dual-chamber ion mirror 120, as shown in FIG. 12*b*, is longer than the single-chamber 100 but their diameters are the same. The dual-chamber conical embodiment 120 has greater radial homogeneity than the single-chamber design. Of course, the dimensions shown in FIGS. 12*a* and 12*b* are for performing numerical experiments and not for the purposes of limiting the dimensions of conical embodiments of the present invention.

While the particular embodiments shown in FIGS. 12*a* and 12*b* comprise rear and/or middle elements comprising conical cross-sections, in an alternative embodiment, only a front element comprises a conical cross-section or a cross-sectional area that increases from front to rear. According to a preferred embodiment of the present invention, the combination of (i) a front element comprising an increasing front to rear cross-sectional area and (ii) a front plate comprising an aperture allows for a gridless ion mirror. Such an embodiment optionally comprises polygonal, circular, and/or ellipsoidal cross-section.

Electric Field Homogeneity

Figure 13:
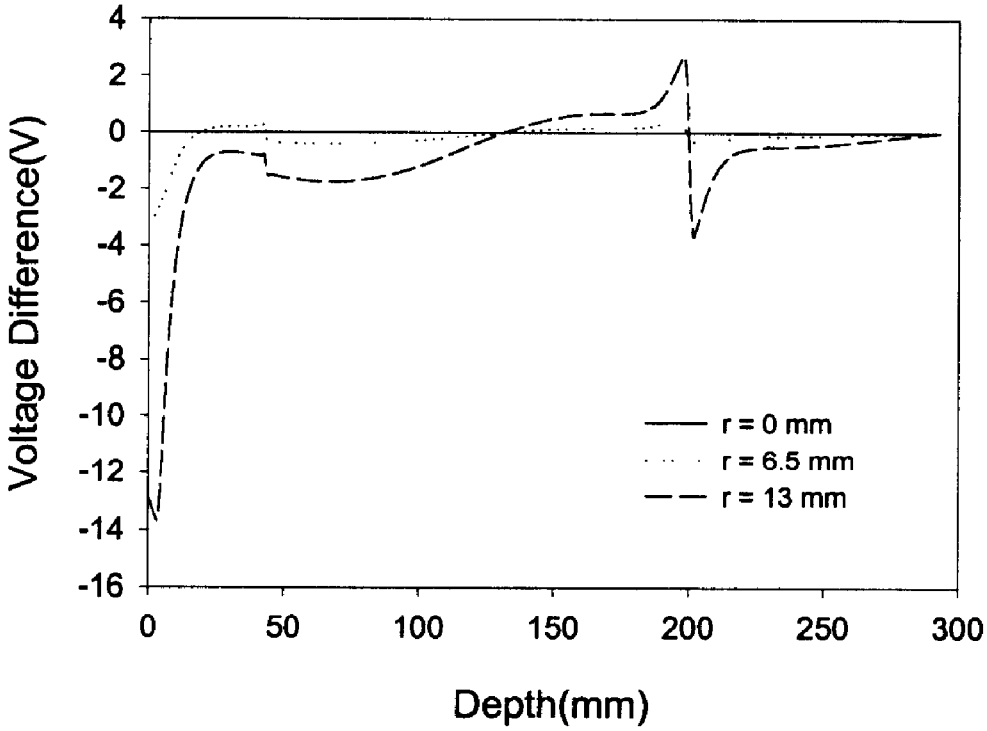
FIG. 13 is a plot of electric field homogeneity of the dual-chamber ion mirror of FIG. 12*b* wherein the vertical coordinate is the voltage difference in the radial direction of ion mirrors from the central axis that is set as "zero" and the horizontal axis is the depth from ion mirror entrance aperture and wherein different lines represent the vertical voltage change from the axial value in ranges.

FIG. 13 shows the electric field homogeneity of the dual-chamber ion mirror 120, as shown in FIG. 12*b*. The traditional voltage-depth plot does not show the electric field distribution in the radial direction since the voltages are so similar that it is difficult to distinguish the difference between them over most regions of the ion mirror. The plot of voltage deviation from the ion mirror axis and depth is used here to show the field changes in the ion mirror (FIG. 13). The plot of FIG. 13 shows that the voltage deviation is the greatest around the front aperture 132 and rear aperture 142. This can also be observed in the above plots of equipotential lines (FIGS. 12*a* and 12*b*) which show a bow shape around the apertures. The voltage deviation increases with increasing radial distance (r) around the mirror axis. For example, the maximum voltage deviation in an approximately 1 inch cross-section area is about 3 V around the aperture but it can be larger than approximately 13 V if the radial distance is increased to approximately 2 inches. This increasing inhomogeneity can affect the mirror performance for wider ion beams because of increased ion dispersion. Increasing the size of the ion mirror can improve the homogeneity, but the bubble in vicinity of the aperture cannot be eliminated. A smaller hole achieves better homogeneity but it also limits the diameter of the ion beam and thus possibly the ion transmission.

Effects of Element Voltages on the Electric Field and Resolving Power

An instrument comprising a two-field ion source, an ion mirror and a detector was simulated as shown in FIG. 11. In this configuration, the flight path length in the field-free region is approximately 78.8 cm and the path length in the ion mirror is approximately 50 cm. The voltages of the middle and rear elements of the mirror are 1250 V and 1900 V. The reflectance angle is approximately 1.3° in either way from normal and the angle of the detector is approximately 5.8°. The diameter of the incident ion beam is approximately 5.5 mm and the beam diameter at the detector is approximately 19.5 mm.

Figure 14:
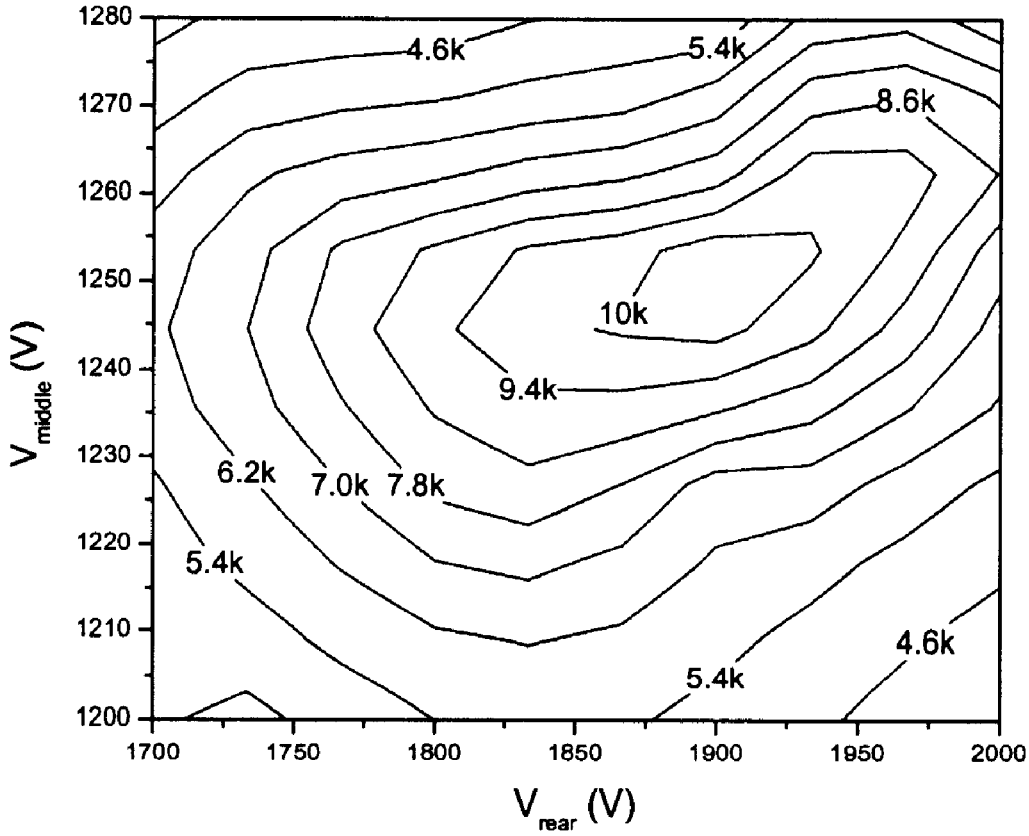
FIG. 14 is a contour plot resolving power for voltages on middle and rear electrodes of the dual-chamber ion mirror of the present invention.

FIG. 14 shows resolving power as a function of the voltages on the middle and rear elements for the dual-chamber ion mirror shown in FIG. 11. To determine the best operating conditions, a simplex optimization in which the voltages of the middle and rear elements are scanned by increments was used. The resolving power is calculated by the equation $R=t_{total}/\Delta t_{total}$ (baseline). The contour line plot is shown in FIG. 14. Local optimum result can be achieved by changing the voltage of one element and keeping the voltage on the other element constant. If the target resolving power is not critical, many different combinations of the middle and rear element voltages can be used.

Figure 15:
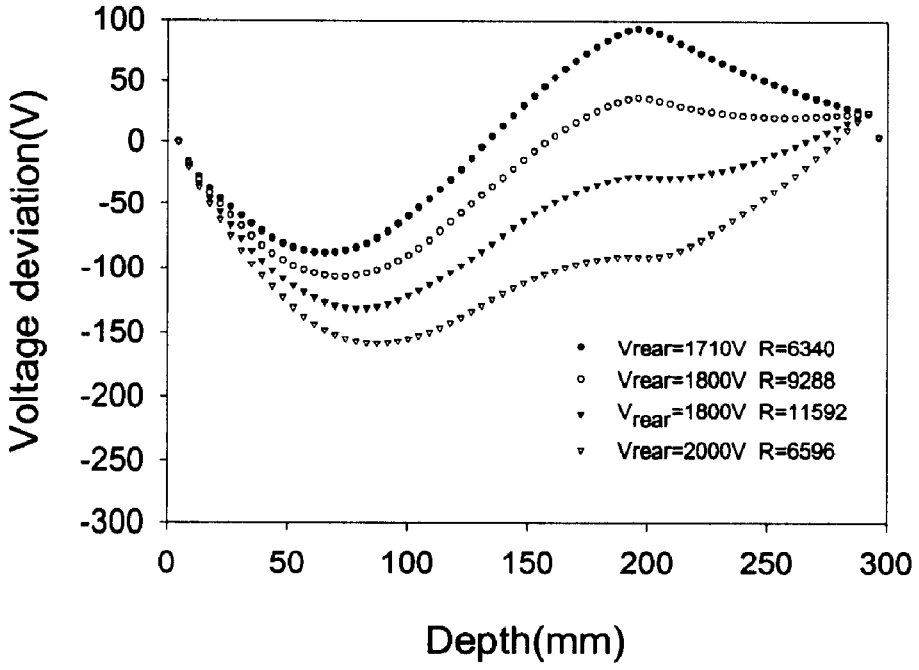
FIG. 15 is a plot of electric field of the dual-chamber mirror of the present invention for different electrode voltages wherein the effect of field shapes on the resolving power is shown in the legend.

FIG. 15 shows the field shape effects on resolving power for a dual-chamber ion mirror, such as that shown in FIG. 11. In order to maximize the electric field difference of different volumes in the ion mirror, voltage deviation from the linear axial value was used. According to the results shown in FIG. 15, ions turned around in the rear curvature part of the second chamber. By changing the voltages of the middle and rear elements, the electric field shapes were changed. Table 3 gives the effect of the middle and rear element voltages on the electric field shape. The field shape can be divided into four parts, the front and rear sections of both the first and second chambers. Table 3 shows the slope change directions for the four parts of the electric field shape. Thus, according to this particular conical embodiment of the present invention, a specific electric field shape can be "designed" by adjusting the two voltages through use of a table of numerical simulation results.

TABLE 3

The effect of the middle and rear element voltages on the electric field shapes

| | Voltage | Field slope of the first chamber | | Field slope of the second chamber | |
|---|---|---|---|---|---|
| | changes | Front | Rear | Front | Rear |
| Middle element voltage | Increase | Steeper | Steeper | Shallower | Steeper |
| | Decrease | Shallower | Shallower | Steeper | Steeper |
| Rear element voltage | Increase | No change* | No change* | Steeper | Steeper |
| | Decrease | No change* | No change* | Shallower | Shallower |

*No obvious change was observed. The whole electric field distribution curve is divided into four parts in the front chamber and the rear chamber. There are the front and rear parts in each chamber. Changing the voltages of the elements affects the electric field distribution. This table shows the effect of each voltage change on the electric field slopes in different parts.

Flight Time Analysis

Figure 16:
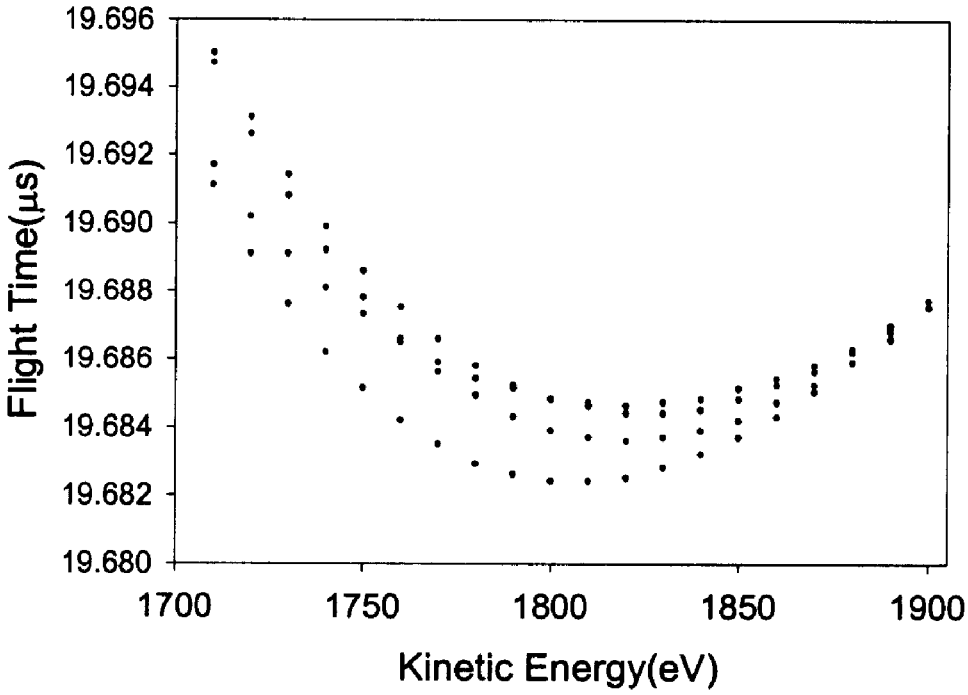
FIG. 16 is a plot of flight time and kinetic energy for the single-chamber ion mirror of the present invention with a voltage of approximately 1935 V on the rear electrode wherein the m/z value for the ions in this experiment was approximately 100 u.

Flight time distributions for the single-chamber ion mirror vs. the ion kinetic energy are shown in FIG. 16. Increasing the voltage on the rear elements changes the flight time distribution. This change allows an operator to choose the optimal operation conditions by shifting the flat region to different kinetic energy ranges. A relatively flat region in the graph is desired for ions over that energy range. The best distribution should be in a shape of "U" with two symmetrical sides. If the conditions are not optimized, the two sides become less and less symmetric. This results in an increase of $\Delta t_{total}$ and a significant decrease in resolving power.

Figure 17:
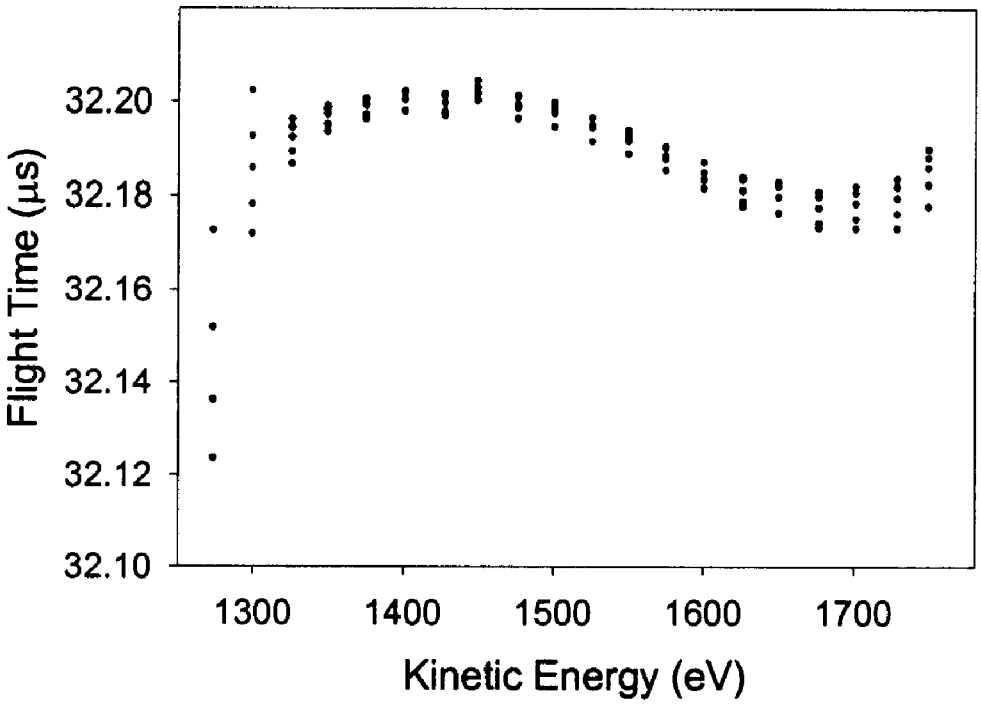
FIG. 17 is a plot of flight time and kinetic energy for the dual-chamber ion mirror of the present invention with a voltage of approximately 1900 V on the rear electrode wherein the m/r value for this experiment was approximately 100 u and wherein $V_{middle}$ was approximately 1250 V.

The flight time distribution of a dual-chamber ion mirror (as shown in FIG. 11) is shown in FIG. 17. Changes in voltage affect the distribution and can be used for optimization during operation. This flight time distribution is affected by changes in electric field shape. The distribution in FIG. 17 is not a "U" but a flattened "S" shape. An increase in the voltage of the rear element or a decrease in the voltage of the middle element can make ions turn around earlier. This lowers the total flight time of higher kinetic energy ions more than that of lower kinetic energy ions. Conversely, a decrease in the voltage of the rear element or an increase in the voltage of the middle element can make ions turn around later. This increases the total flight time of higher kinetic energy ions more than that of lower kinetic energy ions. The flight time distribution depends on the kinetic energy range and the voltages of the middle and rear elements for the demonstrated second-order energy focusing. If ions with a very broad kinetic energy range are analyzed, the flight time packet width over the whole kinetic energy range can be decreased by adjusting the voltages. On the other hand, if ions over a narrow kinetic energy range are analyzed, the flight time packet width of the ions over the partial kinetic energy range can be used and the best resolving power can be achieved. For example, the width of the flight time packet for a 100 eV kinetic energy range in the center of FIG. 17 is less than 10 ns, and therefore a high resolving power can be expected.

Improvements in resolving power come from adjusting the electric field distribution in the appropriate direction. According to a study by Kutscher et al., that presented calculations for the one-dimensional ideal ion mirror (Kutscher, G.; Grix, R.; Li, G.; Wollnik, H., *Int. J. Mass Spectrom. Ion Processes*, 103, 117 (1991)), the first part of electric field distribution until the point where the lowest kinetic energy ion turns back in an ion mirror can be arbitrary. The electric field distribution beyond this point is dependent on the kinetic energy distribution and can be calculated step by step up to any arbitrary kinetic energy. The results obtained by Kutscher et al. show that there is more than one solution for the optimum electric field distribution. In preferred conical embodiments according to the present invention presented herein provide flexibility to achieve a specific electric field distribution experimentally by adjusting the voltages on the middle and rear elements.

Figure 18:
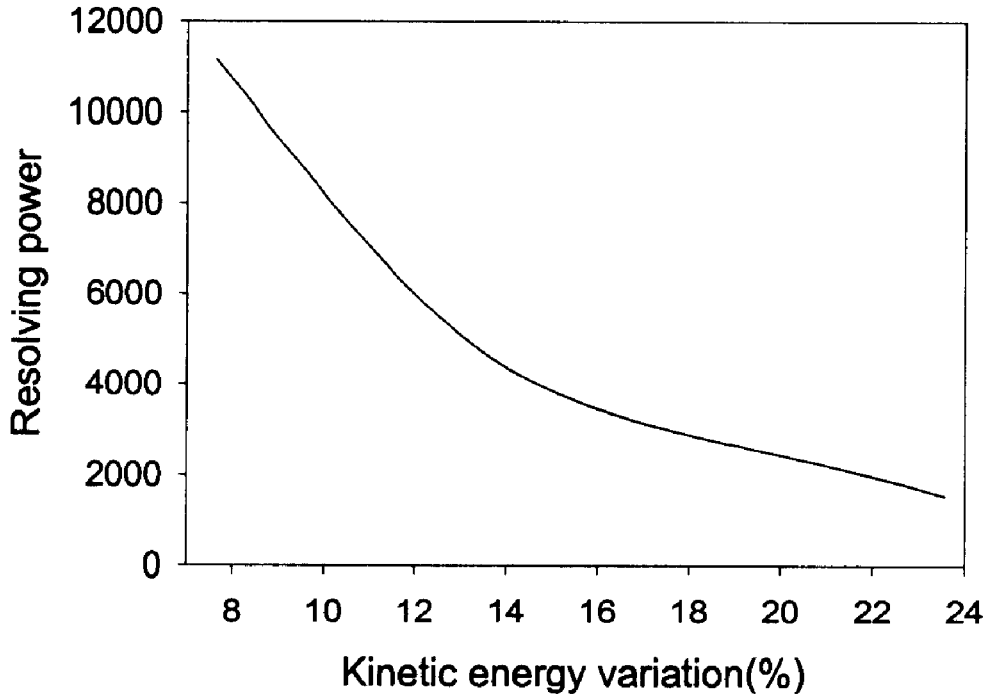
FIG. 18 is a plot of kinetic energy variation and resolving power of the dual-chamber ion mirror of the present invention.

Ions were tested over a kinetic energy range from approximately 1273 eV to approximately 1761 eV. The performance of a dual-chamber ion mirror (as shown in FIG. 11) is shown in FIG. 18. The resolving power depends on kinetic energy range of the ion beam and decreases with an increase in the kinetic energy variation. For a narrow kinetic energy range of approximately 7.5%, the resolving power is approximately 11,195. This kinetic energy variation is achievable with systems like matrix-assisted laser desorption ionization (MALDI) that generate ions with a narrow kinetic energy. When the kinetic energy variation is increased to approximately 13.1%, the resolving power goes down to approximately 4934. This kinetic energy range is on the order of that of electrospray ionization (ESI) for biological molecules. Even for a kinetic energy range of approximately 23.6%, the resolving power is approximately 1566. Interestingly, the resolving power does not decrease so sharply above a kinetic energy range of approximately 13%.

The results presented herein demonstrate that a gridless ion mirror comprising at least one element, and preferably two or three elements, generates an electric field that is non-linear in the axial direction and relatively homogeneous in the off-axis direction. In a preferred embodiment, the entire mirror is closed so the inside electric field is shielded from the surrounding electric fields. Theoretically, gridless mirrors improve ion transmission because there are no generating electric field distortion. However, the field radial homogeneity of the field is less in a gridless configuration than that in the grided configuration. Thus, in general, a gridless configuration does not yield a very high resolving power for a wide ion beam. However, according to a preferred embodiment of the present invention, a relatively thick front plate with a small aperture helps to solve this problem. Gridless ion mirror configurations also compromise ion transmission for resolving power. While cylindrical embodiment of the present invention preferably comprising a front grid, as presented above, is perhaps the best all-around configuration, conical embodiments will be preferred for specific applications.

Ion mirrors comprising other shapes are also within the scope of the present invention. These shapes include, but are not limited to, polygonal shapes, including rectangular shapes. For example, a relatively thick plate with a small aperture optionally replaces a front grid in a cylindrical or rectangular grided configuration to yield adequate resolving power. The present invention also comprises variations wherein mixtures of conical and cylindrical configurations are used (e.g., cone-cylinder-cone or cone-cylinder-cylinder) and/or other polygonal shapes.

Polygonal Embodiments

In a preferred embodiment, the present invention also comprises an ion mirror for time-of-flight mass spectrometers with orthogonal acceleration (TOF-oa). In a preferred embodiment, the mirror comprises three rectangular elements to achieve a specific electric field that is non-linear along the mirror depth direction and relatively homogeneous in a certain rectangular region inside the ion mirror. According to a preferred embodiment, the mirror is polygonal and preferably rectangular. For example, numerical experiments were performed for a rectangular mirror comprising dimensions of approximately 200 mm by approximately 400 mm by approximately 288 mm. In this particular example of the rectangular embodiment, the depths for each rectangular section are approximately 118 mm, approximately 236 mm and approximately 30 mm for the front, middle and rear elements, respectively. In this example, external electric fields are shielded by an approximately 2 mm mirror-wall from a mirror inner field. This example further comprises a single grid at the entrance to the mirror. The configuration of this example is scalable to fit ion beam dimensions by adjusting mirror length and/or mirror width. In a preferred embodiment, only two adjustable voltages need adjustment to obtain an optimum electric field distribution.

Numerical tests (SIMON modeling package) of the aforementioned rectangular ion mirror example of the present invention show that a resolution of 20,000 is achievable for an ion beam with the dimension of approximately 20 mm by approximately 10 mm over a kinetic energy range from approximately 4840 eV to approximately 5200 eV. The predicted peak width for the ions with a mass/charge ratio of approximately 100 is approximately 1.1 ns for an average flight time of approximately 22 $\mu$s. Higher m/z values were also tested and the results confirm that resolution is not a function of m/z.

Figure 19:
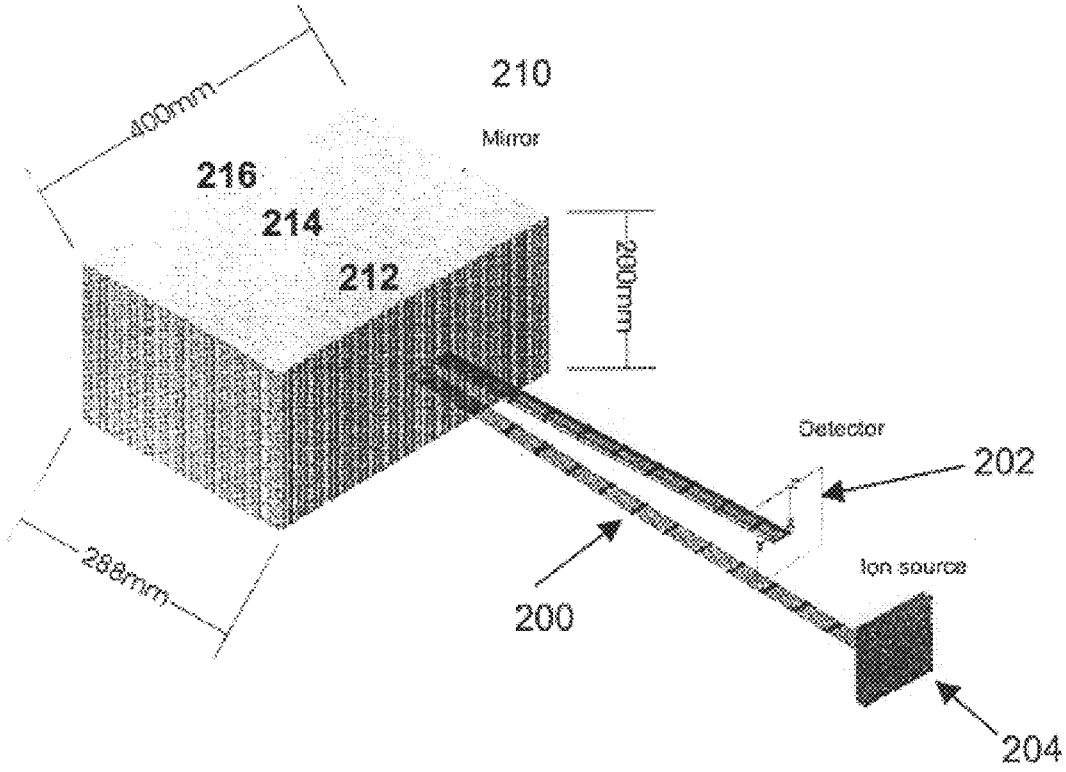
FIG. 19 is a diagram of a polygonal ion mirror of, for example, a TOF-oa mass spectrometer.

Described herein is a preferred embodiment that comprises a rectangular ion mirror configured specifically for TOF-oa mass spectrometers. This particular embodiment comprises an ion mirror comprising three rectangular box elements and a front grid. This particular embodiment is shown in FIG. 19 wherein box walls comprise a thickness of approximately 2 mm. A front box 212 comprises a length of approximately 400 mm, a width of approximately 200 mm and a depth of approximately 118 mm. A middle box 214 comprises a depth of approximately 144 mm with two open ends. A rear box 216 comprises a depth of approximately 30 mm high with a closed rear end. In a preferred embodiment, the front element comprises a grid. This particular embodiment, as shown in FIG. 19, is referred to herein as a minimum element, "shoe-box" mirror.

As shown in FIG. 19, the reflectance angle is approximately 2.0° and the detector angle is approximately 3.7° with respect to the ion source. The ion mirror consists of three rectangular elements. Their lengths are approximately 118 mm, approximately 138 mm and approximately 30 mm. The distance between the ion source and the rectangle mirror is approximately 700 mm and the distance between the rectangular mirror and the detector is approximately 481 mm. The voltages of the middle and rear elements are approximately 4376 V and approximately 5270 V respectively. The initial kinetic energy range of ions from the ion source is from approximately 4840 eV to approximately 5200 eV. The ions are distributed in an area approximately 10 mm wide, approximately 20 mm long and approximately 3 mm deep. Twelve ions were used in the numerical shown.

Referring again to FIG. 19, a sketch of a TOF-oa mass spectrometer with the rectangular mirror is shown. Ions emanate from an ion source 204 via extraction by a linear two-stage electric field with an average acceleration voltage of approximately 5000 V to a field-free region. After travelling in the field-free region, all ions enter the rectangular ion mirror 210. The electric field shape within the mirror 210 provides a flight time for each ion that complements its flight time in the field-free regions. Ions leave the mirror 210 with the same kinetic energy with which they entered. Ions with the same m/z hit a detector 202 over a very narrow time period ($\Delta t$, or the width of arrival time packet).

According to a preferred embodiment, the mirror comprises two adjustable voltages; one at a middle element and the other at a rear element. Adjustment of these two variables provides some control over the focal length of the ion mirror and provides a second-order focusing electric field for high resolution. The high off-axis homogeneity allows generous beam cross-section and minimizes the beam dispersion in the off-axis directions.

The ion trajectory simulation software SIMION 7, (beta) was used to optimize geometric shape, dimensions and ion path factors and to demonstrate the performance of the polygonal embodiment of the present invention. For purposes of numerical experiments, the initial ion kinetic energy range was from approximately 4840 eV to approximately 5200 eV. The initial spatial distribution of ions in the source was approximately 20 mm in length, approximately 10 mm in width and approximately 3 mm in depth. The ion packet depth is related to the initial kinetic energy distribution because of the acceleration electric field strength. A total of 42 ions were evenly distributed along 7 lines, indicated, for example, by the trajectory 200 in FIG. 19, in each experiment (simulation). This number of ions allowed fast convergence in optimization and allowed for easy visualization of the results. The total field free region was approximately 1180 cm long and the angles of ion mirror 210 and the detector were approximately 2.0° and approximately 3.7° with respect to the ion source 202 as shown in FIG. 19.

The Geometric Shades and the Equipotential Lines

According to a preferred embodiment of the present invention, to make an electric field non-linear along the mirror axis and homogeneous in the off-axis directions, the number of elements used is minimized. For example, the rectangular mirror 210 shown in FIG. 19 comprises three elements, each comprising a rectangular box shape 212, 214, 216. In this preferred embodiment, a grid in the front element 212 improves off-axis homogeneity of the electric field at the mirror entrance. As with other embodiments discussed above, a middle grid is optional because the electric field does not change considerably in the region of the middle grid position. The backside of the rear element can be either solid or grided depending on the need for an ion detector at this location.

Figures 2, 20:
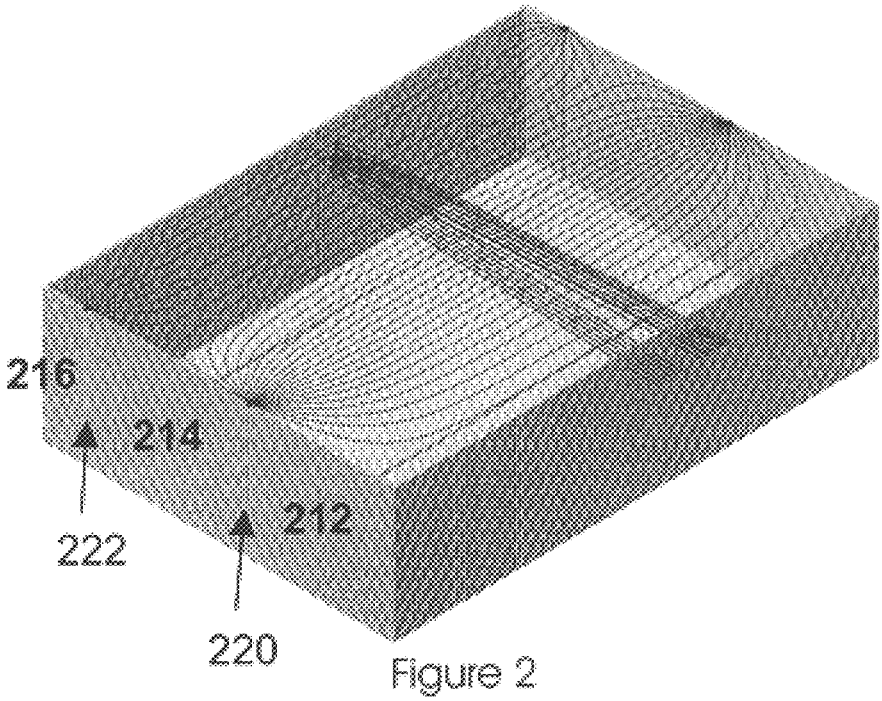
FIG. 20 is a plot of equipotential contour lines of the three-element ion mirror as shown in FIG. 19.

FIG. 20 shows equipotential contour lines from numerical experiments based on the configuration of the preferred embodiment shown in FIG. 19. Thirty lines were used for good visual effect. As shown in FIG. 20, lines emanate from gaps 220, 222 between the elements. The ion mirror of this preferred embodiment as shown comprises a closed structure so that the inside electric field is shielded from the surrounding environment. The flatness of equipotential lines (normality to axis) depends on the dimensions of the mirror and the voltages of middle and rear elements. The equipotential lines around the junction or gap between two adjacent elements are parallel to each each other and the distances between two adjacent contour lines are similar.

The Potential Distributions in the Ion Mirrors

Figure 21A:
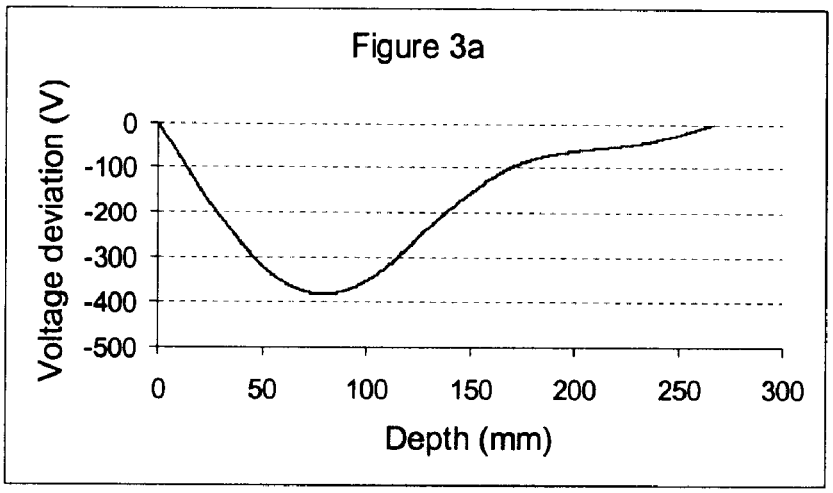
FIG. 21*a* is a plot of electric field homogeneity shown as the on-axis voltage deviation from a linear function from the mirror entrance to the back of the rear element wherein ions are turned back in the upper concave region around 250 mm in depth.
Figure 21B:
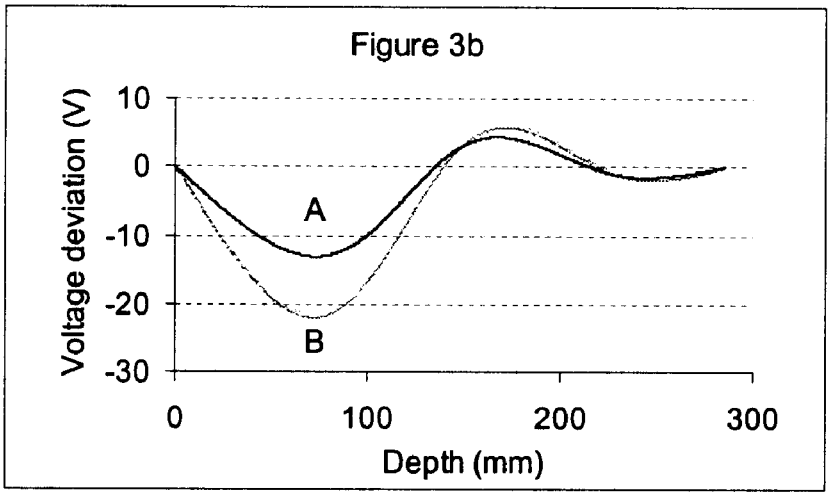
FIG. 21*b* is a plot of electric field homogeneity shown as the off-axis voltage deviation from the on-axis values of FIG. 21*a* for two beam dimensions wherein the dimensions are A: approx. 10 mm by approx. 40 mm and B: approx. 10 mm by approx. 60 mm.

For a typical TOF-oa mass spectrometer, the ion beam is approximately 20 mm long, approximately 10 mm wide and approximately 3 mm thick (see, e.g., Verentchikov, A. N.; Ens, W.; Standing, K. G., *Anal. Chem.*, 66, 126 (1994) and Krutchinsky, A. N.; Chernushevich, I. V; Spicer, V. L.; Ens W.; Standing, K. G., *J. Amer. Soc. Mass Spectrom.*, 9, 569 (1998)). These dimensions determine the region over which the electric field should be homogeneous in the off-axis directions. FIGS. 21*a* and 21*b* show the potential distribution along the flight path of a preferred embodiment of a rectangular ion mirror as discussed above and shown in FIG. 19. FIG. 21*a* shows a plot of voltage deviation from its linear value along the ion mirror's middle axis ($V_{axial}-V_{linear}$). FIG. 21*b* shows a plot of voltage deviation of the off-axis values from the voltage along the mirror's middle axis ($V_{off\text{-}axis}-V_{axial}$). FIG. 21*a* shows the extent of non-linearity in the field along the mirror axis. There are two obvious dips in the field shape. The ions are turned back in the upper region of the second dipped region (near 250 mm). The exact voltage distribution depends on the voltages applied to the elements. As explained for several embodiments presented above, the electric field is optionally divisible into several parts in which the slopes can be adjusted by changing the element voltages.

A plot of the off-axis voltage deviation from the axial field for optimized element voltages is shown in FIG. 21*b*. The voltage deviations for the ion beam cross-section areas A (approximately 10 mm by approximately 40 mm) and B (approximately 10 mm by approximately 60 mm) are plotted. The two curves represent the maximum voltage deviation in each of these areas. The deviation values are between approximately −22 V and approximately +5 V for the worse case. If the beam area can be reduced to approximately 10 mm by approximately 20 mm, the maximum voltage deviation is between approximately −5.5 V and approximately +1.8V with respect to 5000 V. For practical use, the area to be used depends on the initial spatial distribution of ions and the incident angle. When the dimensions of the ion mirror are fixed and the ion beam is thinner, the homogeneity in a relatively small area increases. If the ion beam is wider, the off-axis homogeneity of electric field decreases. Normally, increasing the overall mirror width or height is helpful for improving off-axis homogeneity to fit an ion beam of larger cross-section. For example, if the ion beam has a dimension of approximately 20 mm by approximately 20 mm, the box structure needs to be approximately two times wider to keep the same degree of off-axis homogeneity. The incident angle is another factor related to the off-axis homogeneity after the mirror dimensions are fixed. If this incident angle is increased, the mirror needs to be longer to maintain the same degree of off-axis homogeneity.

Mass Resolution

Figures 4, 22:
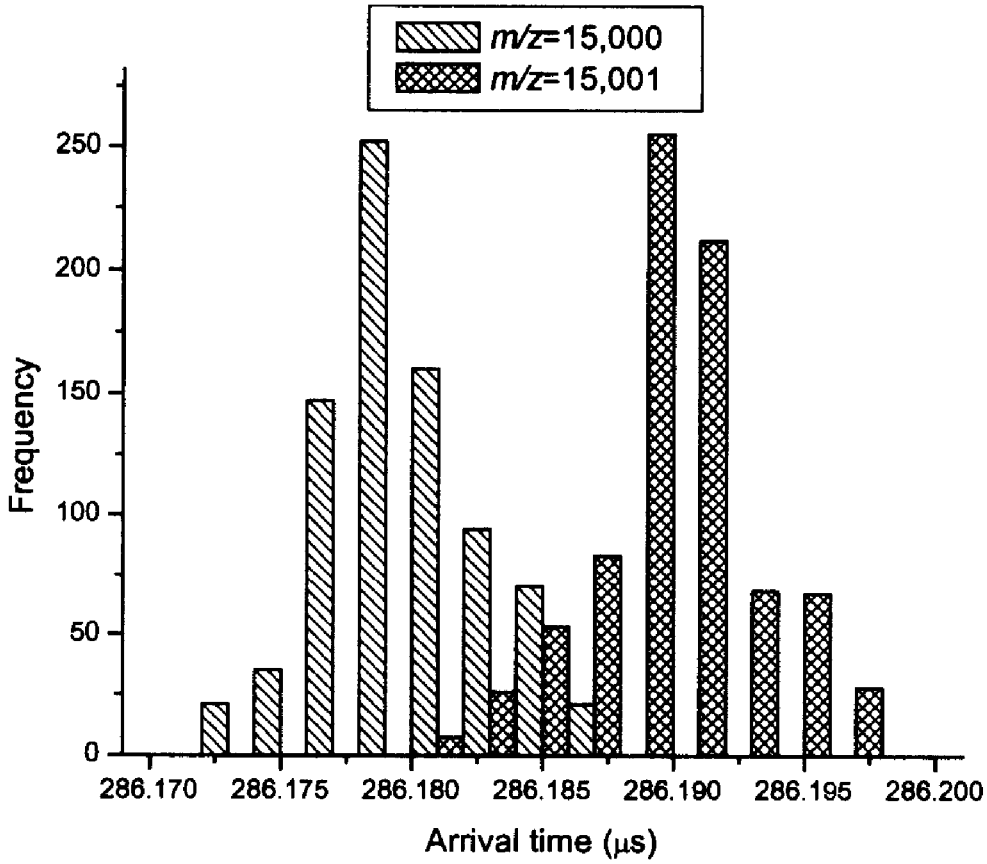
FIG. 22 is a histogram plot of a spectrum of 1600 ions with m/z values of 15,000 (800 ions) and 15,001 (800 ions) wherein an approximately 30% valley separates two adjacent peaks.

In general, average arrival time increases with increasing m/z value. Ions of different m/z values have been modeled for this ion mirror design. FIG. 22 shows a predicted spectrum for ions with m/z values 15,000 and 15,001. As in the experiments discussed above for other embodiments of the present invention, no weighting factor was used for the total flight time distribution. Again, this represents a worst case scenario for ion distribution in the ion source because normally the ions in an ion source are more concentrated in the center of the source. A sample of 1600 ions (800 ions with m/z 15,000 and 800 ions with m/z 15,001) was simulated to predict the spectrum. The vertical axis represents the occurrence frequency of the same m/z ions with approximately the same arrival time. The horizontal axis is the arrival time of these ions. There is about 30% overlap between two adjacent peaks. The calculated resolution is approximately 20,000 (FWHM). There is no overlap from the baseline between the peaks of ions with m/z 10,000 and 10,001.

The Effects of Element Voltages on the Flight Time and Resolution

Figures 5A, 23A:
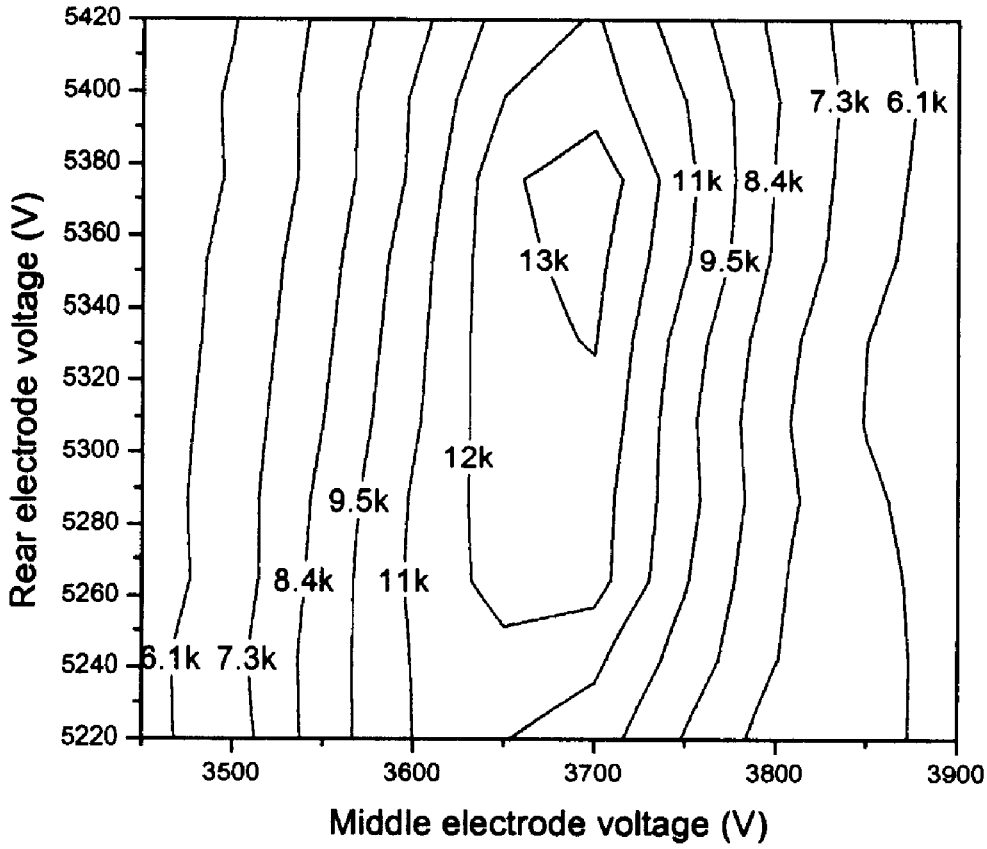
FIG. 23*a* is a contour plot of resolution for element voltages.
Figures 5B, 23B:
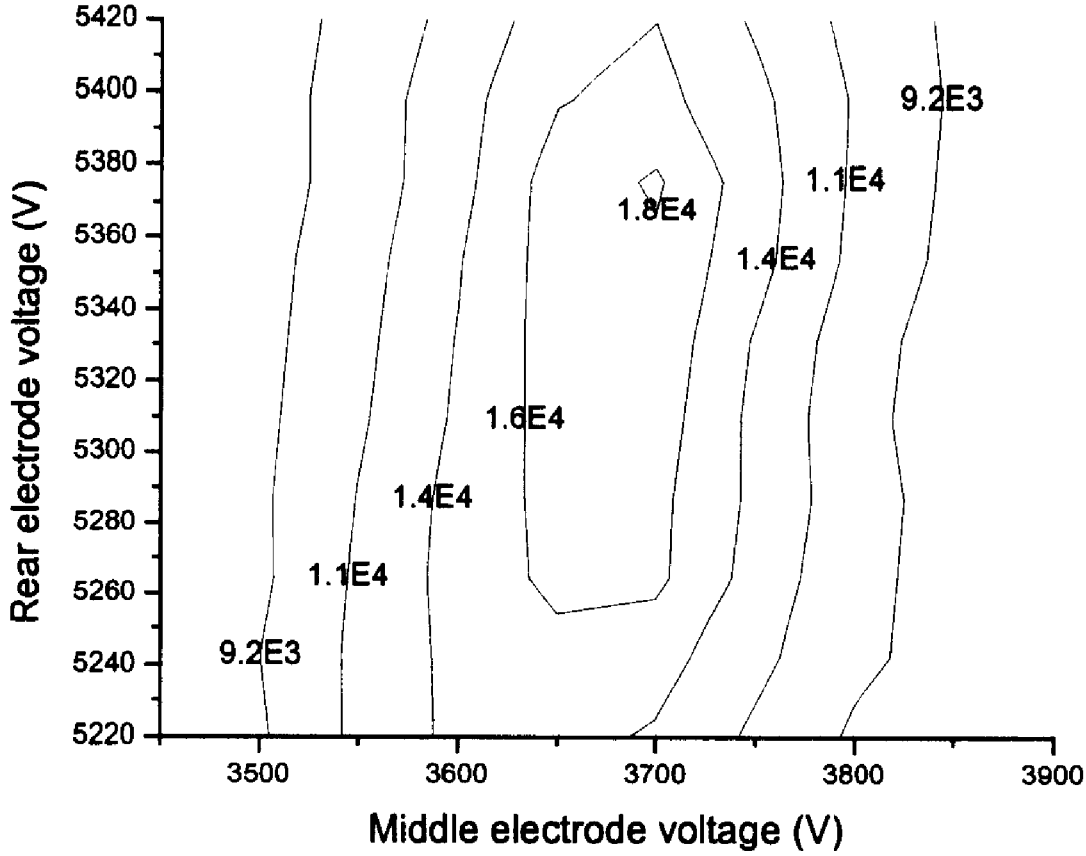
FIG. 23*b* is a contour plot of path length in the field-free region for element voltages.

In a preferred embodiment of the polygonal ion mirror of the present invention, if the ion mirror dimensions are fixed, then there are only two adjustable parameters. According to this preferred embodiment, these are the voltages of the middle and rear elements. The voltages applied affect the electric field distribution and the off-axis homogeneity of the electric field. They must be optimized for the best mirror performance. FIG. 23*a* shows the effect of element voltages on the resolution. The voltage ranges for the middle and rear elements are from approximately 3450 V to approximately 3900 V and from approximately 5220 V to approximately 5420 V, respectively. The voltage steps are approximately 50 volts for the middle element and approximately 50V for the rear element. The results of 50 optimized simulations were used to create the contours. As shown, a high resolution is maintained in certain voltage ranges. FIG. 23*b* shows the effect of element voltages on the optimum field-free path length. The experimental conditions are the same as those used in generating the data presented in FIG. 23*a*. The field-free path length range was from approximately 900 mm to approximately 1380 mm. The resolution range was from approximately 5,900 to approximately 20,000. The plots in FIGS. 23*a* and 23*b* are useful for configuring practical mirrors to match specific instrument parameters. The best resolution is achieved when, for example, the voltage and path length conditions are met. However, the voltages and path lengths that yield adequate resolution are quite flexible. For example, a plurality of combinations of voltages and path lengths exist for a resolution of approximately 12,000.

According to the results presented in FIGS. 23*a* and 23*b*, voltage adjustments for optimum performance are not very critical because the resolution contour as a function of voltage is quite shallow. For the range that produces the best resolution, an empirical equation for the electric field distribution was determined. However, the resulting polynomial had too high an order for attaining the degree of fit that would be needed for practical use. The high order results from the inclusion of the effects of the off-axis inhomogeneity. This is particularly important in TOF-oa mass spectrometry because the incoming and outgoing ion beams must be separated due to the physical separation of the ion source and the detector. The electric field study demonstrates that the off-axis homogeneity changes with the beam dimensions. Also, increasing the reflectance angle increases the overall space occupied by the beam.

The Effect of Element Voltages on the Arrival Time Distribution

Figures 6A, 24A:
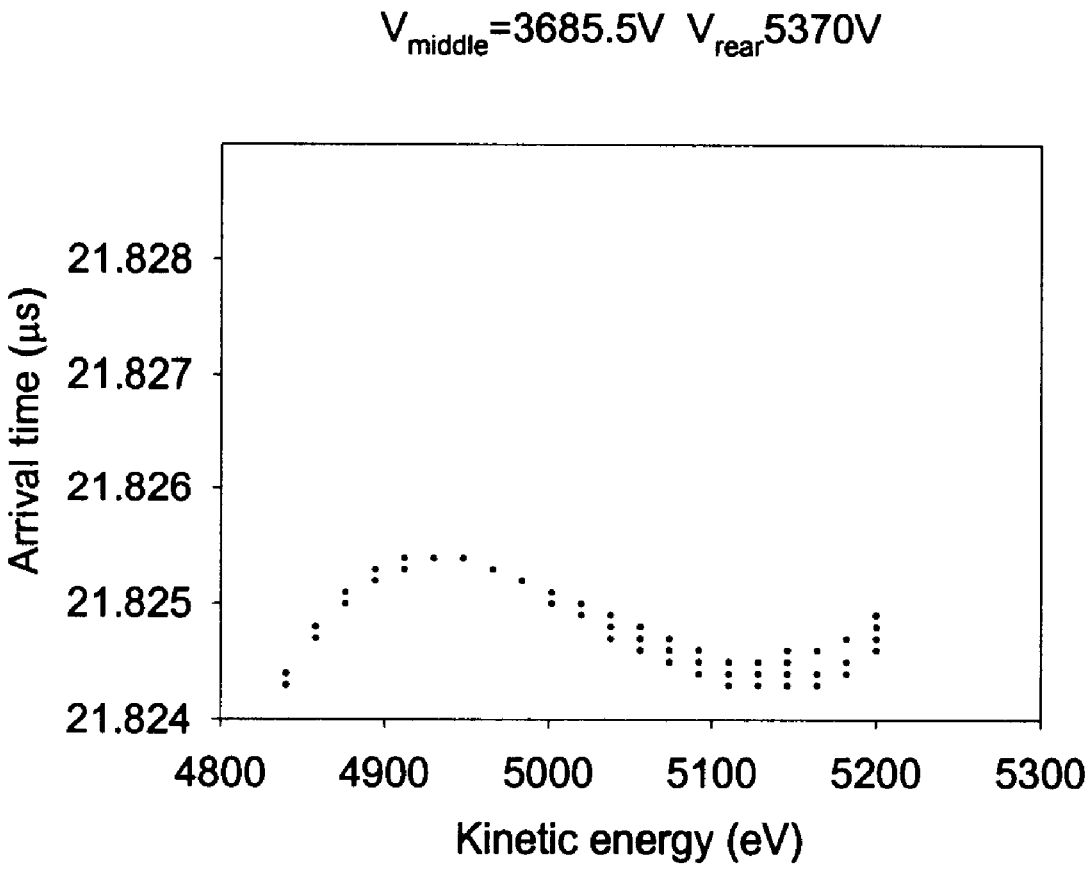
FIG. 24*a* is a plot of arrival time versus kinetic energy for given element voltages ($V_{middle}$=3685.5 V, $V_{rear}$=5370 V) wherein the total flight path in the field-free region is approximately 1080.5 mm.
Figures 6B, 24B:
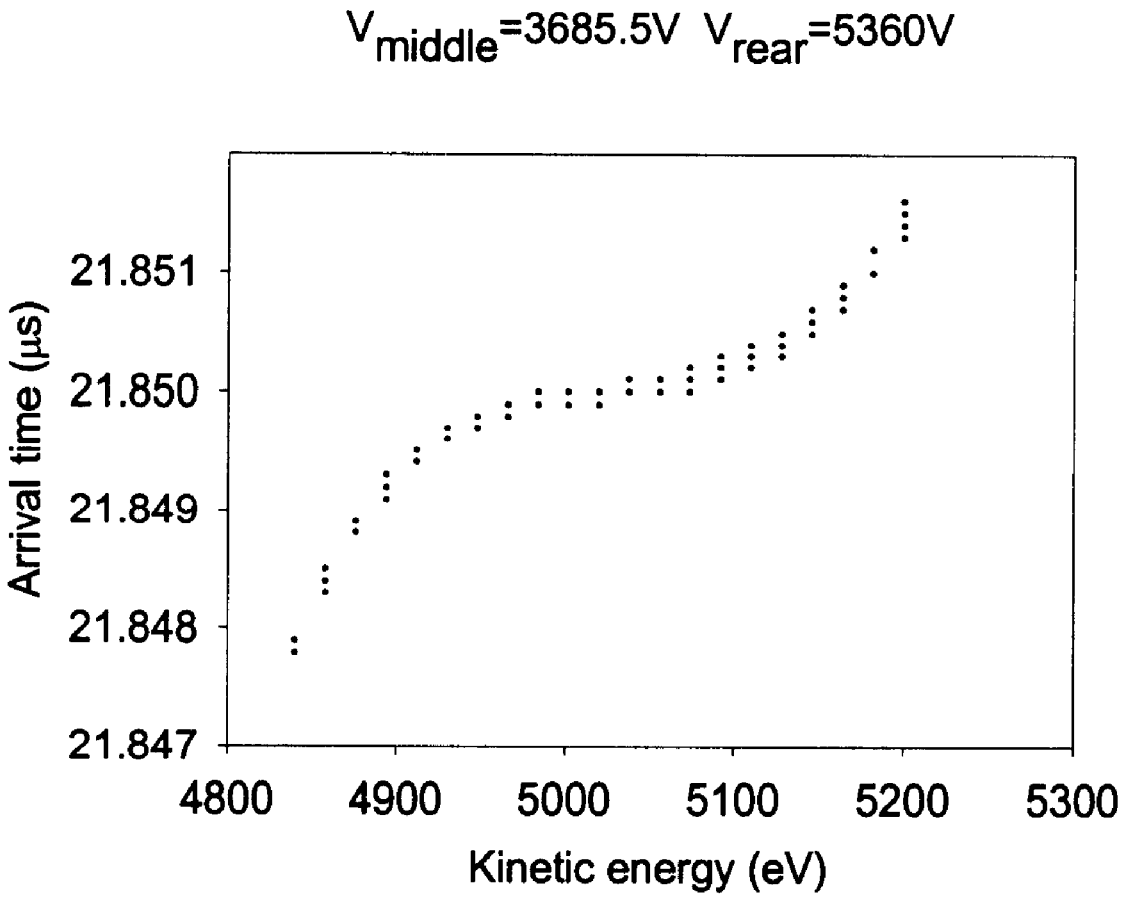
FIG. 24*b* is a plot of arrival time versus kinetic energy for given element voltages ($V_{middle}$=3685.5 V, $V_{rear}$=5360 V) wherein the total flight path in the field-free region is approximately 1080.5 mm.
Figures 6C, 24C:
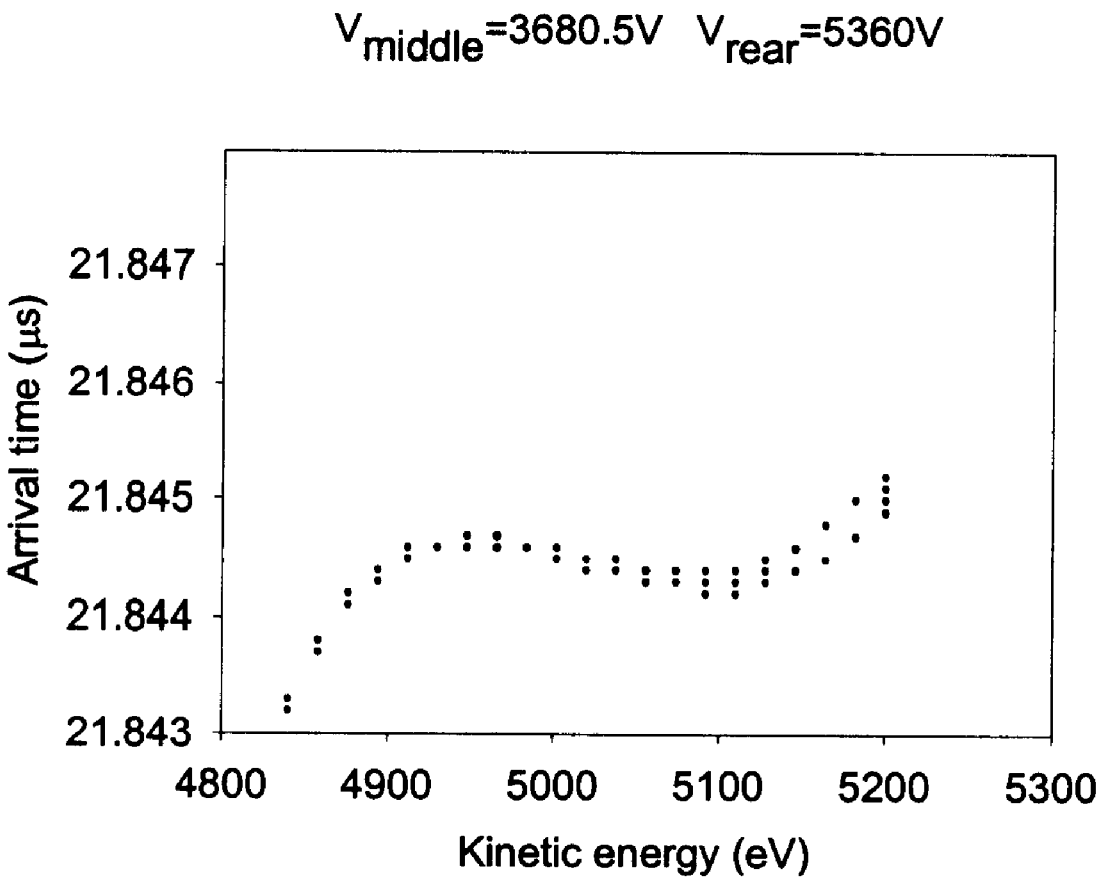
FIG. 24*c* is a plot of arrival time versus kinetic energy for given element voltages ($V_{middle}$=3680.5 V, $V_{rear}$=5360 V) wherein the total flight path in the field-free region is approximately 1080.5 mm.
Figures 6D, 24D:
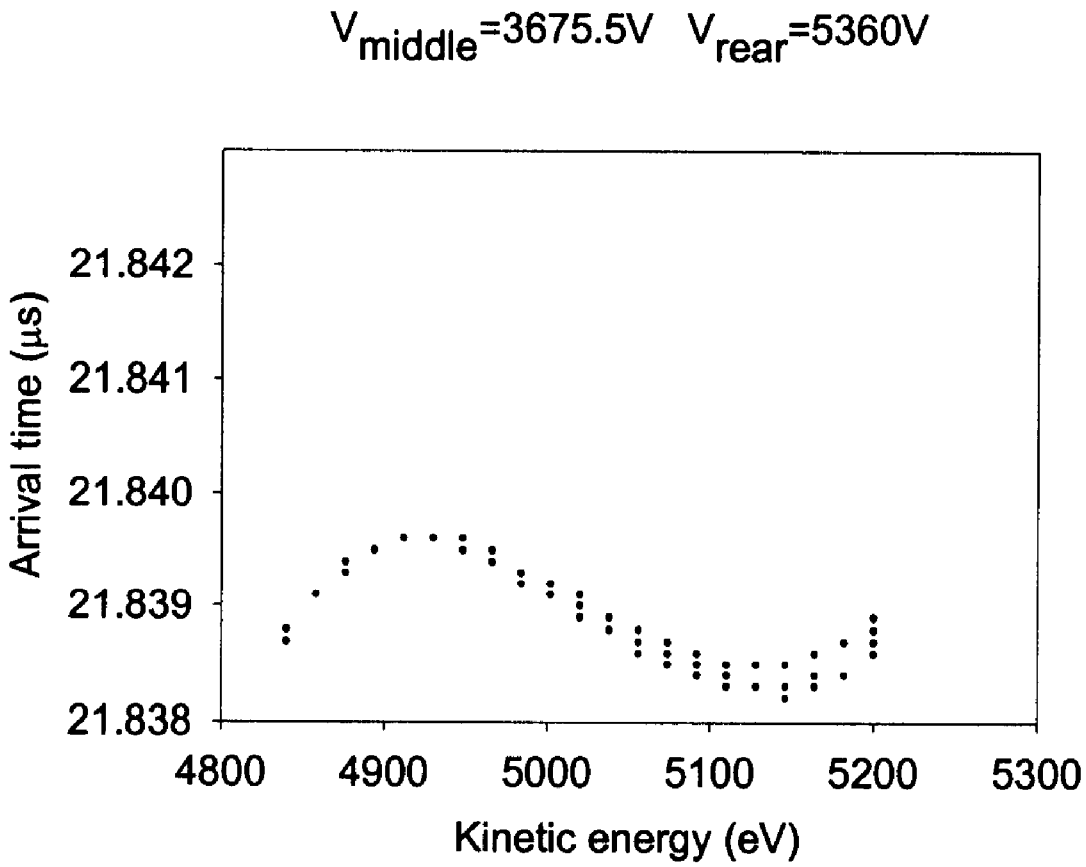
FIG. 24*d* is a plot of arrival time versus kinetic energy for given element voltages ($V_{middle}$=3675.5 V, $V_{rear}$=5360 V) wherein the total flight path in the field-free region is approximately 1080.5 mm.

As demonstrated in numerical experiments for performance of a preferred embodiment, the element voltages chosen affect the on-axis distribution and off-axis homogeneity of the electric field and also influence the total flight time distribution, the average arrival time and the width of the arrival time packet. FIG. 24*a* through FIG. 24*d* show the effects of element voltage on the ion kinetic energy versus arrival time curve. The results presented in these figures are from numerical experiments performed using the SIMON 7 modeling package. The experiments used 175 ions divided into 7 groups in an ion source having a volume of approximately 10 mm by approximately 20 mm by approximately 3 mm. For a given kinetic energy range from approximately 4840 eV to approximately 5200 eV, the narrowest arrival time was achieved with a flattened "S" curve as shown in FIG. 24*a*. With a decrease in the rear element voltage, the higher kinetic energy part of the "S" shape goes up and the width of the arrival time packet becomes broader as shown in FIG. 24*b*. A small decrease in the middle element voltage narrowed the width of the arrival time packet as shown in FIG. 24*c*. A further decrease in the middle element voltage resulted in an "S" shape more flattened and finally improve the mass resolving power as shown in FIG. 24*d*. On the other hand, the shape in FIG. 24*c* would provide much higher resolution (about 70,000) over an energy range from approximately 4900 eV to approximately 5150 eV.

The Effect of the Element Dimensions on the Performance

According to the polygonal embodiment of the present invention, if the mirror voltages are fixed, then mirror dimensions affect the on-axis distribution and the off-axis homogeneity of the electric field. For this reason, the effect of changing the mirror dimensions was tested. The length and width dimensions do not affect the on-axis electric field distribution but do affect the off-axis homogeneity of the electric field. Adequate mass resolution depends on the homogeneity of the electric field region penetrated by the ion beam. In the numerical experiments, the total depth of the ion mirror was fixed, the relative depths of two adjacent elements was changed 4 mm, and simulation results show that both the resolution and the path length were affected by the change. A change of 4 mm can decrease the achievable resolution more than 10%. The effect of the rear element depth is more significant than that of the front and middle elements. A change in the depth of the middle element affects both resolution and path length, but its effect on path length is more significant. It also affects the convergence of the ion beam.

In a preferred embodiment, referred to above as the rectangular shoebox mirror embodiment, the mirror was particularly useful for TOF-oa mass spectrometry primarily because of the rectangular shape of the ion beam. In this embodiment, the large cross-section and dimensions of the ion mirror increase the off-axis homogeneity of the electric field and the mass resolution. Both the relative depths and the voltages of the elements affect the electric field shape which in turn, determines the mass resolution. Because of the large cross-section dimensions, the reflectance angle can be larger than those of both the conical and cylindrical mirrors while the effect of off-axis inhomogeneity is minimized by keeping the beam close to the mirror axis.

In an alternative embodiment, the present invention comprises an additional element to create a "zoom" lens to fit the different path-lengths of a particular instrument. The mass resolution is increased still further if the dimension of the ion mirror is increased, the cross section of the ion beam is reduced or the ion kinetic energy range is narrower. Achievement of exact mass resolution with the usual variety of ionization methods is obtainable with ion mirrors according to several preferred embodiments of the present invention.

Dimensions shown in the Figures were for the purpose of performing numerical experiments and therefore are not to be construed as limitations to the present invention.

The preceding examples can be repeated with similar success by substituting the generically or specifically described reactants and/or operating conditions of this invention for those used in the preceding examples.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. An apparatus for affecting charged particles comprising:

at least two tube-shaped, electrically conductive elements arranged along a common axis wherein each of said at least two elements comprises a finite length; and at least one voltage source for providing a voltage to at each of said at least two elements wherein the provided voltage produces an electrical field comprising field lines perpendicular to said common axis for affecting charged particles travelling substantially parallel to said common axis.

2. The apparatus of claim 1 wherein each element comprises at least one cross-section normal to said common axis wherein said at least one cross-section comprises a shape selected from the group consisting of circular, ellipsoidal, oval, and polygonal shapes.

3. The apparatus of claim 2 wherein said cross-sectional area varies along said common axis.

4. The apparatus of claim 1 wherein at least one electrical field comprises a non-linear electrical field along said common axis.

5. The apparatus of claim 1 wherein at least one of said at least two elements comprises a grid.

6. The apparatus of claim 1 wherein at least one of said at least two elements comprises a plate.

7. The apparatus of claim 6 wherein said plate defines an aperture.

8. The apparatus of claim 1, said apparatus comprising a charged particle mirror wherein charged particles enter said apparatus substantially parallel to said common axis, reverse direction and exit said apparatus substantially parallel to said common axis.

9. The apparatus of claim 8 wherein said mirror provides for at least first order focusing of charged particles.

10. The apparatus of claim 8 wherein said mirror provides for at least second order focusing of charged particles.

11. The apparatus of claim 1, said apparatus comprising a charged particle lens.

12. The apparatus of claim 1, said apparatus comprising a charged particle zoom lens comprising at least one element movable along said common axis.

13. The apparatus of claim 1 comprising two elements.

14. The apparatus of claim 1 comprising three elements.

15. The apparatus of claim 1 comprising a front element comprising an increasing cross-sectional area from front to rear.

16. The apparatus of claim 15 wherein said front element further comprises a front plate defining an aperture.

17. The apparatus of claim 1 wherein the charged particles enter and exit along the common axis.

18. The apparatus of claim 1 wherein the charged particles enter at an angle and exit at another angle to the common axis.

19. The apparatus of claim 18 wherein said angles comprise angles of less than approximately 15 degrees.

20. The apparatus of claim 1 wherein said at least two elements comprise an orthogonal arrangement about said common axis.

21. The apparatus of claim 1 further comprising a gap between adjacent elements.

22. An ion mirror for mass spectroscopy comprising:

at least two tube-shaped, electrically conductive elements arranged along a common axis wherein each of said at least two elements comprises a finite length; and at least one voltage source for providing a voltage at each of said at least two elements wherein the provided voltage produces an electrical field comprising field lines perpendicular to said common axis for reflecting ions travelling substantially parallel to said common axis.

23. The ion mirror of claim 23, said mirror providing for second order focusing.

* * * * *